US011542046B2

(12) United States Patent
Ishizuka et al.

(10) Patent No.: US 11,542,046 B2
(45) Date of Patent: Jan. 3, 2023

(54) BANDING AND PACKAGING DEVICE

(71) Applicant: Osaka Sealing Printing Co., Ltd., Osaka (JP)

(72) Inventors: Akinori Ishizuka, Habikino (JP); Tetsuya Kishimoto, Osaka (JP); Kenichi Shibao, Osaka (JP)

(73) Assignee: OSAKA SEALING PRINTING CO., LTD., Osaka (JP)

( * ) Notice: Subject to any disclaimer, the term of this patent is extended or adjusted under 35 U.S.C. 154(b) by 210 days.

(21) Appl. No.: 16/766,073

(22) PCT Filed: Dec. 1, 2017

(86) PCT No.: PCT/JP2017/043273
§ 371 (c)(1),
(2) Date: May 21, 2020

(87) PCT Pub. No.: WO2019/106825
PCT Pub. Date: Jun. 6, 2019

(65) Prior Publication Data

US 2020/0346797 A1 Nov. 5, 2020

(51) Int. Cl.

| | |
|---|---|
| ***B65B 11/10*** | (2006.01) |
| ***B65B 11/48*** | (2006.01) |
| ***B65B 41/12*** | (2006.01) |

(52) U.S. Cl.
CPC ..... *B65B 11/10* (2013.01); *B65B 11/48* (2013.01); *B65B 41/12* (2013.01)

(58) Field of Classification Search
None
See application file for complete search history.

(56) References Cited

U.S. PATENT DOCUMENTS

| | | | | |
|---|---|---|---|---|
| RE28,535 E * | 9/1975 | Ganz | B65B 53/02 | 53/448 |
| 3,908,332 A * | 9/1975 | Ebbinghaus | B65B 11/105 | 53/48.9 |
| 3,938,650 A * | 2/1976 | Holt | B65B 35/243 | 198/433 |
| 4,197,935 A * | 4/1980 | Aterianus | B65G 47/31 | 198/460.1 |
| 4,841,715 A * | 6/1989 | Suga | B65B 11/105 | 53/210 |

(Continued)

FOREIGN PATENT DOCUMENTS

| | | |
|---|---|---|
| CN | 101204996 A | 6/2008 |
| CN | 203652848 U | 6/2014 |

(Continued)

*Primary Examiner* — Hemant Desai
*Assistant Examiner* — Tanzim Imam
(74) *Attorney, Agent, or Firm* — Norris McLaughlin, P.A.

(57) ABSTRACT

The present invention provides a device including an article carry-in mechanism (1A) that transports an article (w) to a packaging position (P), an article carry-out mechanism (1B) that carries the article (w) away from the packaging position (P), and a relaying mechanism (1C) disposed between the article carry-in mechanism (1A) and the article carry-out mechanism (1B). The relaying mechanism (1C) receives and supports the transported article (w) from below in a center part of the article (w) in a direction of its width.

7 Claims, 17 Drawing Sheets

(56) References Cited

U.S. PATENT DOCUMENTS

| | | | | | |
|---|---|---|---|---|---|
| 5,457,942 | A * | 10/1995 | Mantovani | ..... | B65B 51/10 53/329.2 |
| 2004/0159527 | A1* | 8/2004 | Williamson | ..... | B65B 25/046 198/459.1 |
| 2008/0142341 | A1 | 6/2008 | Layne et al. | | |
| 2010/0012462 | A1* | 1/2010 | Cerf | ..... | B65G 47/088 198/434 |

FOREIGN PATENT DOCUMENTS

| | | | | | |
|---|---|---|---|---|---|
| EP | 2777829 | A1 * | 9/2014 | ..... | B07C 5/36 |
| JP | 2002-20006 | A | 1/2002 | | |
| JP | 2002-330692 | A | 11/2002 | | |
| JP | 3125847 | U * | 10/2006 | | |
| JP | 3125847 | U | 10/2006 | | |
| JP | 2014-234173 | A | 12/2014 | | |
| JP | 2015-074467 | A | 4/2015 | | |
| JP | 2015-085955 | A | 5/2015 | | |
| JP | 2015085955 | A * | 5/2015 | | |

* cited by examiner

BANDING AND PACKAGING DEVICE

TECHNICAL FIELD

The present invention relates to a device for use in banding and packaging a target article, in which a piece of band-shaped film is wound around and attached to the article.

BACKGROUND ART

Examples of such a banding and packaging device are described in the patent documents 1 and 2 filed by the applicant of the present invention. As described in these documents, a piece of band-shaped film is held and transported by a film piece transporting mechanism to a predetermined position, released at the position, and then carried onto an article to be packaged. Then, the article and the piece of film attached to the article are vertically held together by an upper transport belt and a carry-in belt of an article transport apparatus and then transported to a packaging position.

In the device described in the patent document 1, a packaging position P is set to locate between the end of a carry-in belt 10 and the beginning of a carry-out belt 11, as schematically illustrated in the side view of FIG. 24. As illustrated with arrow A in the drawing, an article "w" and a piece of film (not illustrated in the drawing) attached to this article are vertically held together by the carry-in belt 10 and an upper transport belt 12 and then transported to the packaging position P. The transport of the article "w" by the carry-out belt 11 and the upper transport belt 12 is suspended when the article arrives at the packaging position P.

As schematically illustrated in the front view of FIG. 25, a film piece pressing mechanism is disposed at a position in the upper direction of the packaging position P. The film piece pressing mechanism is equipped with a pair of pressing members 42 used to press parts of the piece of film "f" downward that are hanging out from the left and right sides of the article "w". A film piece attaching mechanism is disposed at a position below the packaging position P. The film piece attaching mechanism is equipped with a pair of attaching members 62 that are allowed to move leftward and rightward.

As illustrated in FIG. 26, the pressing members 42 on the left and right sides move downward toward the article "w" at the packaging position P between the end of the carry-in belt 10 and the beginning of the carry-out belt 11, and both end sides of the piece of film "f" hanging out from the left and right sides of the article "w" are pressed downward by the pressing members 42 along the surfaces of the article "w" on its lateral sides.

After that, the attaching members 62 on the left and right sides move in the horizontal direction and arrives at positions for attaching the piece of film underneath the article "w", as illustrated in FIG. 27. Then, the piece of film "f" hanging downward from the article "w" is pressed by the attaching members 62 and thereby wound around the bottom surface of the article "w". Lastly, starched parts on both end sides of the piece of film are elastically pressed against and attached to the bottom surface of the article "w".

The article, after the piece of film "f" is wound around and attached to its bottom surface, starts to be transported by the carry-out belt 11 and the upper transport belt 12. The banding-completed article "w" is then carried out of the device.

Thus, when one end and the other of the film-attached article "w" are situated on the end of the carry-in belt 10 and the beginning of the carry-out belt 11, i.e., when the lateral and bottom surfaces of the article "w" are being exposed, both end sides of the piece of film "f" are pressed downward and then pressed against and attached to the bottom surface of the article "w". This is considered to be an efficient way of successfully banding and packaging target articles.

PRIOR ART DOCUMENT

Patent Document

Patent Document 1: JP 2015-74467A
Patent Document 2: JP 2015-85955A

SUMMARY OF INVENTION

Technical Problem

In the banding and packaging devices described in the earlier documents, however, the upper transport belt 12 may be an indispensable means in order for the film-attached article "w" to be vertically held and transported to the packaging position P, often resulting in higher facility costs.

Supposing that the upper transport belt 12 is not used in such devices, the article "w", without being vertically supported by this belt, may be difficult to retain its horizontal position when arriving at the packaging position P between the end of the carry-in belt 10 and the beginning of the carry-out belt 11. As a result, an edge of the article "w" may get caught in between these belts 10 and 11 and fail to be further transported.

Taking for instance the article "w" relatively small in length in the direction of transport, it may be only a limited area of the article "w" that can rest on the end of the carry-in belt 10 and on the beginning of the carry-out belt 11. When the carry-in belt 10 and the carry-out belt 11 are driven after the packaging is over, the packaged article "w" may happen to slip on the belts 10 and 11 in the absence of the upper transport belt 12, failing to depart from the packaging position for further transport.

To address these issues of the known art, the present invention is directed to providing a banding and packaging device allowed to smoothly transport and reliably band articles to be packaged without vertically holding the articles.

Solution to the Problems

To this end, the present invention provides the following technical features.

1) A banding and packaging device according to the present invention is provided with: an article carry-in mechanism that transports an article to a packaging position; a film piece transporting mechanism that transports a piece of film formed in a band shape onto the article at the packaging position; a film piece pressing mechanism that presses the piece of film on the article against the article at the packaging position and that further presses ends of the piece of film on both sides thereof downward; a film piece attaching mechanism that winds the piece of film around a bottom surface of the article and that attaches the ends pressed downward by the film piece pressing mechanism to the bottom surface; an article carry-out mechanism that transports from the packaging position the article wound with the piece of film, with the ends thereof being attached to the bottom surface; and a relaying mechanism that receives and supports the article being transported from below at a position between the article carry-in mechanism and the article carry-out mechanism. The packaging position is set to locate between the article carry-in mechanism and the article carry-out mechanism. The relaying mechanism receives and supports the article in a center part of the article in a direction of width of the article orthogonal to a direction of transport of the article.

In the banding and packaging device according to the present invention, a piece of band-shaped film is transported by the film piece transporting mechanism onto an article that has been transported by the article carry-in mechanism. Then, the film piece pressing mechanism presses the piece of film downward against the article and further presses lateral ends on both sides of the piece of film downward. Then, the film piece attaching mechanism winds the pressed-down ends of the piece of film around the bottom surface of the article and attaches the ends to the bottom surface. After the article to be packaged is thus wound with the piece of film, the packaged article is transported by the article carry-out mechanism to depart from the packaging position.

Between the article carry-in mechanism and the article carry-out mechanism where the packaging position is located, the relaying mechanism receives and supports the article being transported from below. Thus, an edge of the article transported by the article carry-in mechanism may be prevented from getting caught in between the article carry-in mechanism and the article carry-out mechanism. This may ensure smooth transport of the article from the article carry-in mechanism to the article carry-out mechanism without having to vertically hold and transport the article as in the known art. At the packaging position between the article carry-in mechanism and the article carry-out mechanism, therefore, the article to be packaged may be successfully wound with the piece of film by the film piece pressing mechanism and the film piece attaching mechanism.

Between the article carry-in mechanism and the article carry-out mechanism, the relaying mechanism receives and supports the article from below in a center part of the bottom surface of the article in the direction of width. That is, since the relaying mechanism receives and supports the article in this center part of the bottom surface of the article in the direction of width, an open space is provided around the article other than below the center part of the bottom surface of the article in the direction of width. This open space may allow the film piece pressing mechanism and the film piece attaching mechanism to smoothly perform their operations without interference of the relaying mechanism, i.e., operation of the film piece pressing mechanism to press the piece of film against the article and to press both ends of the piece of film downward, and operation of the film piece attaching mechanism to wind the ends of the piece of film pressed downward by the film piece pressing mechanism around the bottom surface of the article and to attach the ends to the bottom surface.

2) In a preferred embodiment of the present invention, the relaying mechanism includes a relaying belt conveyer that transports the article. The relaying belt conveyer includes a transport belt small in width that supports the center part in the direction of width.

In this embodiment that provides the relaying belt conveyer for transport of the article, the article, if relatively small in length along the direction of transport, may be smoothly transported by the relaying belt conveyer to and from the packaging position between the article carry-in mechanism and the article carry-out mechanism.

Because a relatively small belt in width is used as the transport belt of the relaying belt conveyer to receive and support the center part of the bottom surface of the article in the direction of width, lateral sides of the bottom surface of the article in the direction of width at the packaging position are left exposed. This may avoid any interference with the operation of the film piece attaching mechanism in which the ends on both sides of the piece of film are wound around and attached to the lateral sides of the bottom surface of the article in the direction of width.

3) In another embodiment of the present invention, the article carry-out mechanism includes a carry-out belt conveyer. The transport belt small in width is wound around a pulley of the carry-out belt conveyer to have the relaying belt conveyer driven by the carry-out conveyer.

In this embodiment, the relaying belt conveyer of the relaying mechanism is driven by the carry-out belt conveyer of the article carry-out mechanism. As a result, a driving mechanism solely used to drive the relaying belt conveyer may become unnecessary, allowing the device to be structurally simplified.

In this embodiment characterized in that the transport belt of the relaying belt conveyer is wound around the pulley of the carry-out belt conveyer, the relaying belt conveyer and the carry-out belt conveyer are continuous in the direction of transport with no gap therebetween.

The bottom surfaces of some articles may not be flat. For example, some articles may have projections on their bottom surfaces that are protruding downward along widths of the articles. This embodiment seeking to avoid any gap between the relaying belt conveyer and the carry-out belt conveyer may prevent the risk of such projections on bottom surfaces of article getting caught in between the relaying belt conveyer and the carry-out belt conveyer. allowing smooth transport of any articles.

4) In yet another embodiment of the present invention, the article carry-in mechanism includes a carry-in belt conveyer, and a support plate that receives and supports the article from below is disposed between the carry-in belt conveyer and the relaying belt conveyer.

In this embodiment that provides the support plate between the carry-in belt conveyer and the relaying belt conveyer to receive and support the article from below, articles with projections on their bottom surfaces, for example, may be received and supported well by the support plate. Thus, such projections of the articles, if any, may be prevented from getting caught in between the article carry-in mechanism and the relaying belt conveyer.

5) In one embodiment of the present invention, the film piece pressing mechanism includes an upper surface pressing member that presses, under own weight, the piece of film against an upper surface of the article, and lateral side pressing members that press down both end sides of the piece of film pressed against the upper surface by the upper surface pressing member along lateral surfaces of the article.

In this embodiment, the piece of film that has been transported to and put on the article is lightly pressed against the upper surface of the article by the upper surface pressing member under its own weight. The piece of film pressed by this pressing member may remain in contact with the upper surface without even partly floating off the upper surface. The lateral ends of the piece of film thus pressed against the upper surface of the article are then pressed down by the lateral side pressing members along surfaces of the article on its both sides. While articles to be packaged may differ in height, the upper surface pressing members that move downward under their own weight may be allowed to apply a constant pressing force to the article "w". Thus, the pressing force may be unlikely to become variable; too strong or too weak, depending on the height of the article "w".

6) In a preferred embodiment of the present invention, the film piece pressing mechanism includes a support bracket allowed to move upward and downward. The lateral side pressing members are immovably coupled to the support bracket, the upper surface pressing member is supported by the support bracket in a vertically movable manner under own weight, and the upper surface pressing member approaches the upper surface of the article earlier than the lateral side pressing members in response to the downward movement of the support bracket.

In this embodiment, simple downward and upward movements of a single member; support bracket, may successfully invite the upper surface pressing member to act upon the upper surface of the article, and then invite the lateral side pressing members to act upon the lateral surfaces of the article. Thus, the respective pressing members may be driven in a more simplified manner than being driven independently.

7) In yet another embodiment of the present invention, the upper surface pressing member of the film piece pressing mechanism presses the piece of film against lateral sides of the upper surface of the article in the direction of width.

A belt relatively small in width is used as the transport belt of the relaying belt conveyer to receive and support the center part of the bottom surface of the article. The article received and supported by such a narrow transport belt may easily lose balance in the direction of width. In this embodiment, the upper surface pressing member of the film piece pressing mechanism presses, through the piece of film, both sides of the article in the direction of width from above. The article thus supported at three points; center part of the bottom surface and parts on both sides of the upper surface in the direction of width, may be stabilized in its position and direction.

Effects of the Invention

The device provided by the present invention is equipped with the article relaying mechanism that relays the transport of the article between the article carry-in mechanism and the article carry-out mechanism. Thus, an edge of the article transported by the article carry-in mechanism may be prevented from getting caught in between the article carry-in mechanism and the article carry-out mechanism. This may ensure smooth transport of the article from the article carry-in mechanism to the article carry-out mechanism without having to vertically hold and transport the article as in the known art.

The relaying mechanism is structured to receive and support the article from below in a center part of the bottom surface of the article in the direction of width. Thus, an open space is provided around the article except where the relaying mechanism is located, supporting the center part from below. This open space may allow the respective mechanisms to smoothly perform their operations, i.e., operation of the film piece pressing mechanism to press the piece of film against the article and to press both ends of the piece of film downward, and operation of the film piece attaching mechanism to wind the ends of the piece of film pressed downward by the film piece pressing mechanism around the bottom surface of the article and to attach the ends to the bottom surface.

DESCRIPTION OF EMBODIMENTS

Embodiment

An embodiment of the present invention is hereinafter described with reference to the accompanying drawings.

Figure 1:
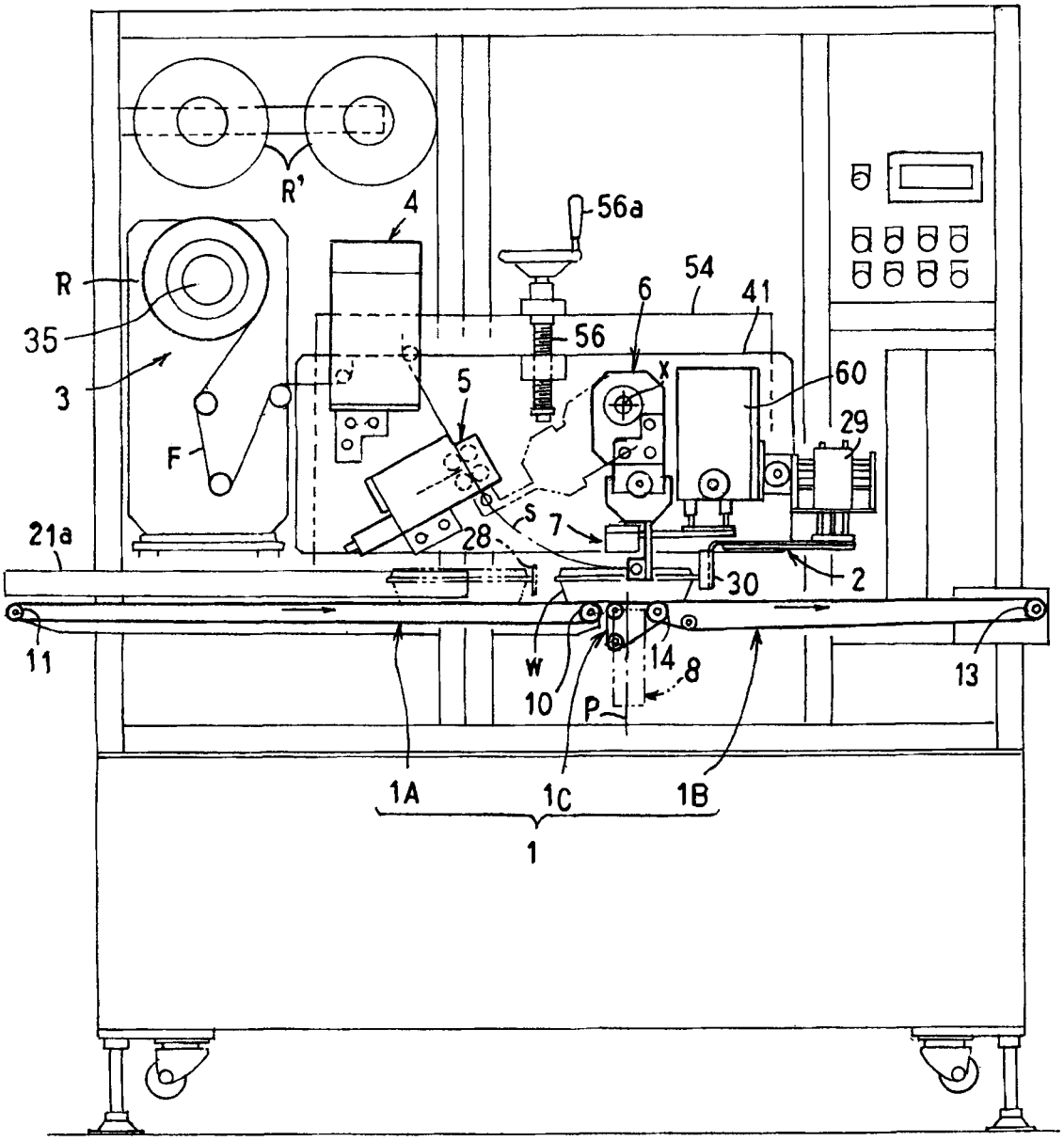
FIG. 1 is a side view of a banding and packaging device according to an embodiment of the present invention.
Figure 2:
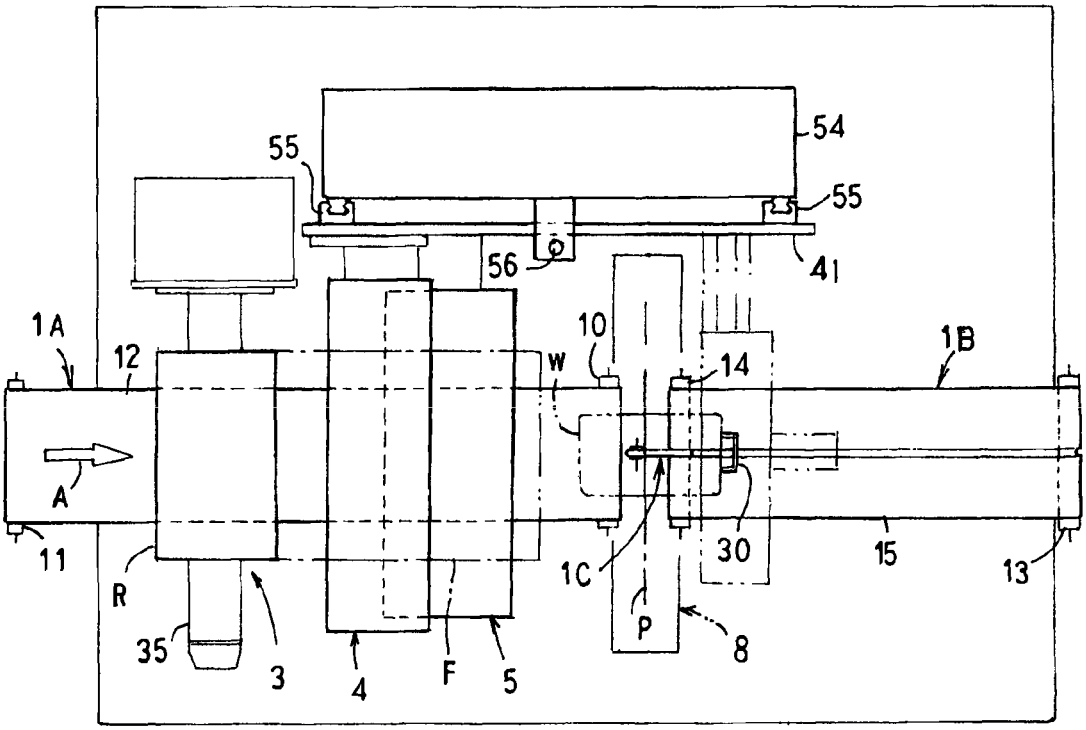
FIG. 2 is a schematic plan view of the banding and packaging device illustrated in FIG. 1.

FIG. 1 is a side view of a banding and packaging device according to an embodiment of the present invention. FIG. 2 is a schematic plan view of the banding and packaging device.

The banding and packaging device according to this embodiment may be for use in banding and packaging an article "w" such as a container with a lid containing, for example, food.

This device is equipped with an article transporting mechanism 1, an article positioning mechanism 2, a film feeder 3, a printing processor 4, a film piece former 5, a film piece transporting mechanism 6, a film piece pressing mechanism 7, and a film piece attaching mechanism 8. The article transporting mechanism 1 receives the article "w" and transports the article "w" put thereon along a horizontally extending transport path illustrated with arrow A in FIG. 2. The article positioning mechanism 2 locates and retains the transported article "w" at a packaging position P which is an intermediate position on the article transport path. The film feeder 3 feeds a wide sheet of raw film F. The printing processor 4 prints what is to be printed on the raw film F. The film piece former 5 cuts the printed sheet of raw film F at a constant pitch to form a piece of band-shaped film "f" described later. The film piece transporting mechanism 6 feeds the piece of film "f" onto the article "w" located at the packaging position P. The film piece pressing mechanism 7 presses a center part of the piece of film "f" in its lateral direction against the upper surface of the article "w", presses ends of the piece of film "w" on both sides downward, and then folds the piece of film "f" downward along lateral surfaces of the article "w". The film piece attaching mechanism 8 winds the folded ends of the piece of film "f" around the bottom surface of the article "w" and attaches the ends to the bottom surface.

In the description given below, "forward" may be used to express an upstream side in a direction of transport A of the article "w" (left on the drawings FIGS. 1 and 2), "rearward" may be used to express a downstream side in the direction of transport A (right on the drawings FIGS. 1 and 2), and "lateral" may be used to express a direction horizontally orthogonal to the direction of transport A.

The article transporting mechanism 1 includes an article carry-in mechanism 1A and an article carry-out mechanism 1B. The article carry-in mechanism 1A receives the article "w" and horizontally transports the article "w" put thereon to the packaging position P located rearward. The article carry-out mechanism 1B horizontally transports the article "w" further rearward after the article "w" is banded and packaged at the packaging position P. In this article transporting mechanism 1, an article carry-in path and an article carry-out path are linearly extending and continuous to each other.

The article carry-in mechanism 1A is equipped with a carry-in belt conveyer in which a wide transport belt 12 is wound around a rear driving pulley 10 and a front driven pulley 11 that are driven by a motor and respectively disposed at positions rearward and forward. The article carry-out mechanism 1B is equipped with a carry-out belt conveyer in which a wide transport belt 15 is wound around a rear driving pulley 13 and a driven pulley 14 that are driven by a motor and respectively disposed at positions rearward and forward.

The end of the belt conveyer of the article carry-in mechanism 1A and the beginning of the belt conveyer of the article carry-out mechanism 1B are spaced apart with an interval greater than the length of the piece of film "f". The packaging position P is located in the interval. The article "w" is wound with a piece of film to be packaged at the packaging position P.

In this embodiment, the article transporting mechanism 1 is further equipped with a relaying mechanism 1C. The relaying mechanism 1C is disposed between the article carry-in mechanism 1A and the article carry-out mechanism 1B to ensure smooth transport of the article "w" without having to vertically hold the article "w".

Figure 4:
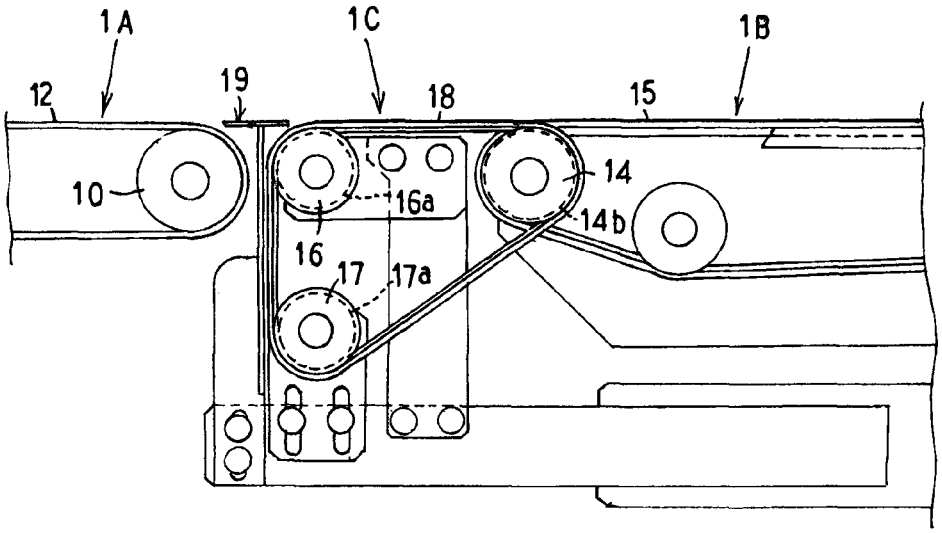
FIG. 4 is a side view illustrating a relaying mechanism of the article transporting mechanism illustrated in FIG. 1.
Figure 5:
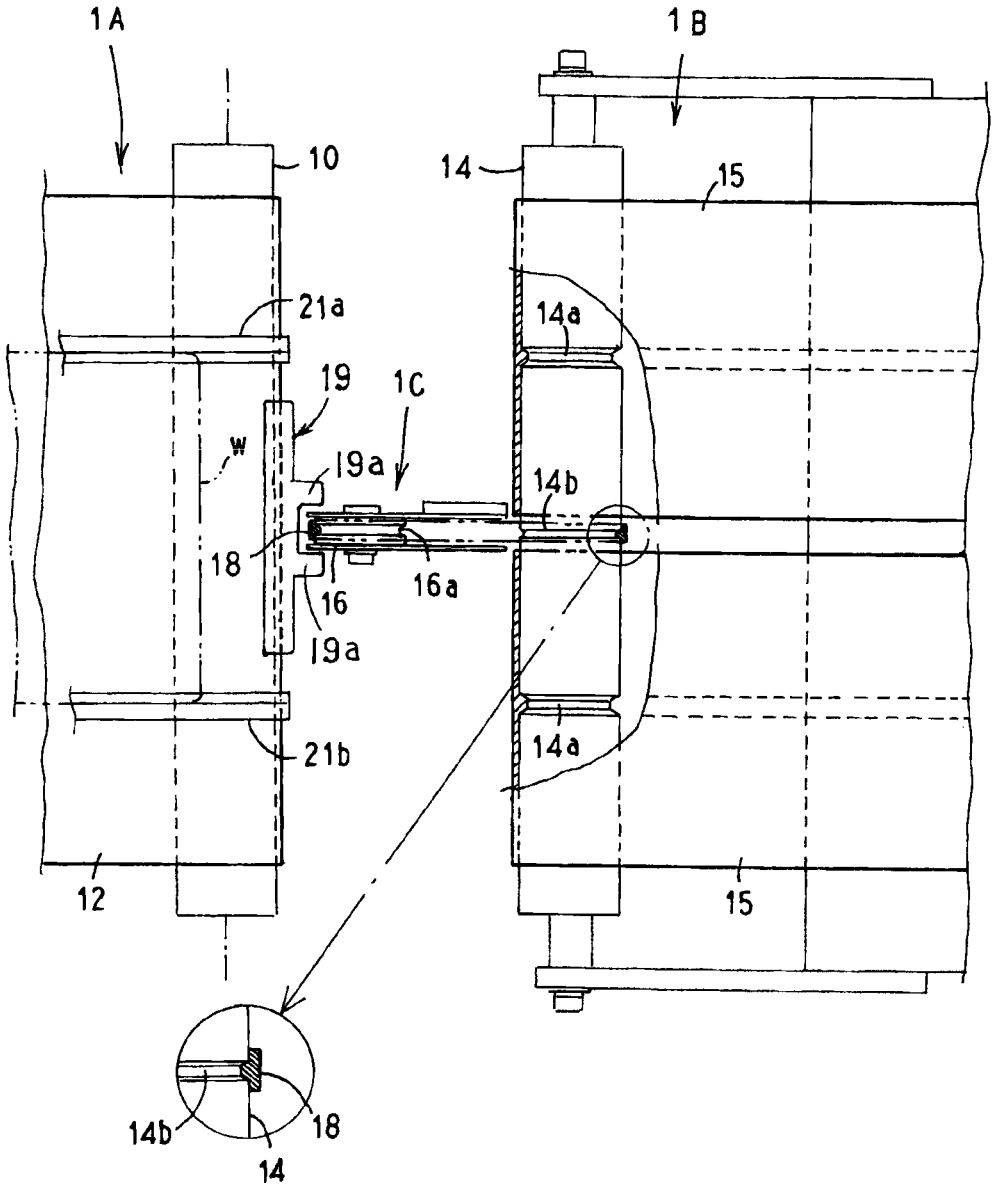
FIG. 5 is a plan view illustrating the relaying mechanism of the article transporting mechanism illustrated in FIG. 1.

FIG. 4 is a side view illustrating the relaying mechanism 1C. FIG. 5 is a plan view illustrating the relaying mechanism 1C.

The relaying mechanism 1C according to this embodiment is equipped with a relaying belt conveyer in which a small transport belt 18 in width is wound around three pulleys; the driven pulley 14 of the article carry-out mechanism 1B serving as driving pulley, and a driven pulley 16 at a forward position and a tension pulley 17 disposed below the driven pulley 16.

The transport belt 15 of the article carry-out mechanism 1B is split at a center position in the lateral direction into two belt portions. These two belt portions are engaged with guiding grooves 14*a* of the driven pulley 14 and thereby positioned in the lateral direction. There is a small interval formed at a center position in the lateral direction between the belt portions, and the narrow transport belt 18 of the relaying mechanism 1C is wound around the driven pulley 14 in this small interval. The transport belt 18 of the relaying mechanism 1C is engaged with guiding grooves 14*b* of the driven pulley 14, guiding grooves 16*a* of the driven pulley 16, and guiding grooves 17*a* of the tension pulley 17, and thereby positioned in the lateral direction.

The narrow transport belt 18 of the relaying mechanism 1C is thus disposed at a position at the center in the lateral direction and transports the work "w" while receiving and supporting, from below, a center part of the bottom surface of the work "w" in the lateral direction. The surface of the transport belt 18 that supports the bottom surface of the article "w" has a flat shape in the lateral direction. The transport belt 18 supports the article "w" on this flat surface.

The width N1 of the narrow transport belt 18 may be thus defined; width N1 of transport belt 18≤distance L1, where L1 is a distance between both ends of a piece of film "f" wound around the work "w", as illustrated in the front view of an article banding and packaging step of FIG. 20 described later.

When the piece of film "f" is attached to the work "w" by the "film piece attaching mechanism" according to the present invention, a part of the bottom surface of the article "w" is left unwound with this this piece of film. Such a film-missing part of the bottom surface, however, may be supported well by the transport belt 18 insofar as the dimension of the width N1 is less than or equal to the distance L1 between the both ends of the piece of film "f" wound around the work "w".

The width N1 of the transport belt may be defined otherwise, as in the formula below, using diameters D1 of roll-type attaching members 81.

Width N1 of transport belt 18≤(distance L1−diameters D1), where D1 is the diameter of each attaching member, and L1 is a distance between both ends of the piece of film "f" wound around the work "w".

As described in this embodiment, the "film piece attaching mechanism" according to the present invention has a pair of roll-type attaching members 81, and the attaching members 81 each have the diameter D1. When the attaching members 81 are brought into contact with both ends of the piece of film "f" wound around the bottom surface of the article "w", these attaching members enter a film-missing inner region of the bottom surface, each by a radial dimension (D1/2), i.e., by a diametrical dimension (D1) altogether, from one end side of the piece of film "f".

The width of the film-missing inner region corresponds to the distance L1 between both ends of the piece of film "f" wound around the work "w". The largest possible dimension of the width N1 of the transport belt 18 is, therefore, equal to a distance calculated by subtracting the diameters (D1) of the attaching members 81 from the distance L1, i.e., (distance L1 between both ends of piece of film "f" wound around work "w")−(diameters L1 of attaching members 81).

Thus defined, the transport belt 18 supporting the work "w" may be prevented from interfering with the attaching members 81 moving toward the ends of the piece of film "f" when the piece of film "w" is wound around and attached to the bottom surface of the article "w".

The width N1 of the transport belt 18, though desirably greater in order to more reliably support the work "w", may preferably be set to a dimension suitable for any piece of film "f" having a large width in the lateral direction. i.e., any piece of film "f" with a smaller distance L1 between its both ends when wound around the work "w". The upper-limit value of the width N1 of the transport belt 18, therefore, may preferably be 10 mm, or more preferably be 8 mm.

On the other hand, the lower-limit value of the width N1 of the transport belt 18 may preferably be 5 mm, or more preferably be 6 mm in the context of better support for the work "w".

The width N1 of the transport belt 18, therefore, may preferably be in the range of 10 mm to 5 mm, or more preferably be in the range of 8 mm to 6 mm.

In the relaying belt conveyer of the relaying mechanism 1C, the transport belt 18 is wound around the pulleys including the driven pulley 14, serving as driving pulley, of the carry-out belt conveyer of the article carry-out mechanism 1B. The relaying belt conveyer is thus driven by the carry-out belt conveyer.

A driving mechanism solely used to drive the relaying mechanism 1C may be accordingly unnecessary, allowing the device to be structurally simplified.

Some articles "w" may have flat bottom surfaces, while the others may have projections protruding downward along their widths in the lateral direction. Smooth transport may possibly fail with such an article "w" with a projection(s) on its bottom surface due to the risk of the projection getting caught in between two transport belts disposed forward and rearward in the direction of transport when the article currently transported on one of the transport belts is carried onto the other.

In this embodiment, the transport belt 18 of the relaying mechanism 1C is wound around the driven pulley 14 of the article carry-out mechanism 1B, and the transport belt 18 of the relaying mechanism 1C and the transport belt of the article carry-out mechanism 1B are continuous forward and rearward in the direction of transport.

Thus, any articles "w" with projections may be smoothly transported without the risk of the projections getting caught in between the two transport belts.

As illustrated in FIG. 4, there is a gap between the end of the transport belt 12 of the article carry-in mechanism 1A and the beginning of the transport belt 18 of the relaying mechanism 1C. In this embodiment, a fixed support plate 19 is disposed between the transport belts 12 and 18 to receive and support the article "w" from below. As illustrated in FIG. 5, the support plate 19 is located at a position in the upper direction of the end of the transport belt 12 of the article carry-in mechanism 1A and is extending along the lateral direction. The support plate 19 has a pair of support pieces 19*a* extending rearward so as to hold therebetween the beginning of the transport belt 18 of the relaying mechanism 1C from both sides in the lateral direction. With this support plate 19, the transport belt 12 of the article carry-in mechanism 1A and the transport belt 18 of the relaying mechanism 1C are gapless and continuous forward and rearward in the direction of transport.

The device thus structured may ensure smooth transport of the article "w" with a projection(s) protruding downward on its bottom surface without the risk of the projection getting caught in between the transport belts 12 and 18 transports belts.

In the case of the article "w" relatively small in the direction of transport, for example, it may be only a limited area of the article that can rest on the end of the transport belt 12 of the article carry-in mechanism 1A and on the beginning of the transport belt 15 of the article carry-out mechanism 1B when the article is at the packaging position P between the end and the beginning of these transport belts.

In the absence of the relaying mechanism 1C, such a small article "w" in the direction of transport, if transported on the transport belt 12, 15 being driven after the packaging is completed, may happen to slip on the transport belt 12, 15, failing to depart from the packaging position P for further transport. In this embodiment, however, the relaying belt conveyer of the relaying mechanism 1C is provided to ensure reliable and smooth transport of the article "w".

Figure 3:
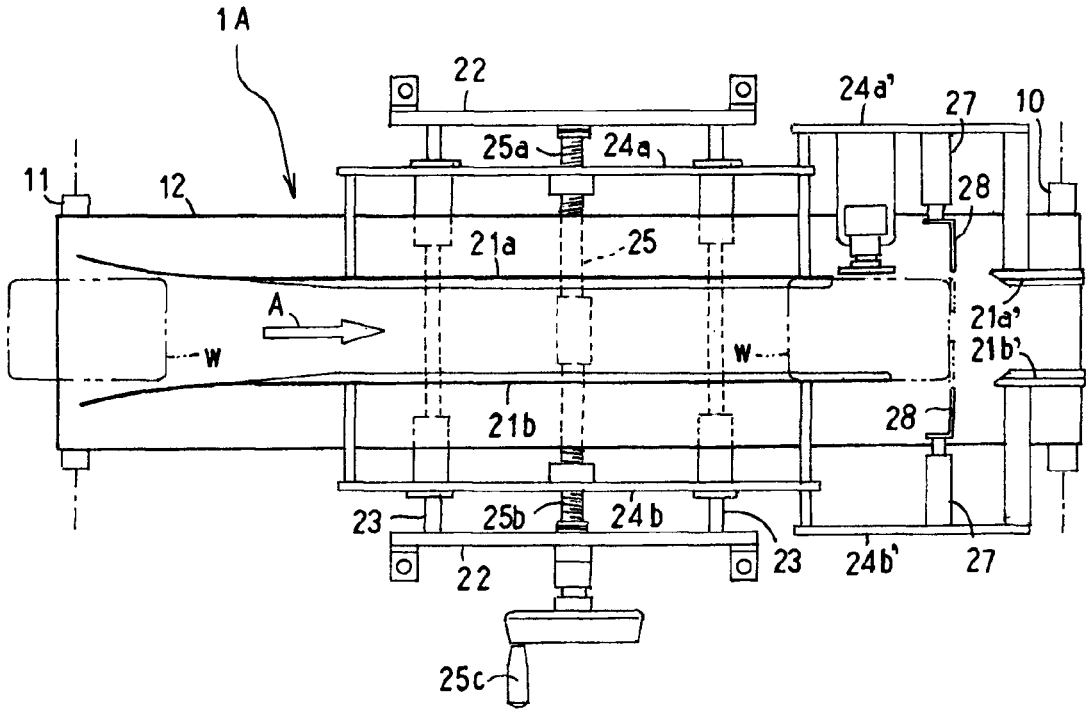
FIG. 3 is a plan view illustrating an article carry-in mechanism of an article transporting mechanism illustrated in FIG. 1.

As illustrated in FIG. 3, transport guides 21*a* and 21*b* are disposed on the carry-in belt conveyer of the article carry-in mechanism 1A to guide the article "w" from both sides in the lateral direction. The transport guides 21*a* and 21*b* are supportably coupled respectively to movable frames 24*a* and 24*b* that are allowed to slide in the lateral direction along guiding shafts 23 disposed at positions forward and rearward in the direction of transport and horizontally supported across fixed frames 22. An operating shaft 25 horizontally supported across the fixed frames 22 has a left threaded shaft portion 25*a* and a right threaded shaft portion 25*b* having opposing lead angles. The left threaded shaft portion 25*a* and the right threaded shaft portion 25*b* are inserted through and engaged with the movable frames 24*a* and 24*b*. The operating shaft 25 is rotated in forward and reverse directions by manipulating a handle 25*c* disposed on one end side in the lateral direction to allow the movable frames 24*a* and 24*b* to move on the threads in opposite directions. Thus, the transport guides 21*a* and 21*b* are allowed to move toward and away from each other in accordance with the width of the article "w" in the lateral direction.

The transport guides 21*a* and 21*b* and the movable frames 24*a* and 24*b* are respectively split into two portions that are spaced apart at two positions forward and rearward in the direction of transport. In a space formed as a result of the transport guides and the movable frames being split into two portions, braking stoppers 28 are disposed at positions on both sides in the lateral direction. The braking stoppers 28 are allowed to laterally move toward and away from the transport path between the transport guides 21*a* and 21*b*. Actuators 27, an example of which is air cylinder, are mounted to rearward movable frame 24*a*' and 24*b*' split from the movable frames 24*a* and 24*b*. The braking stoppers 28 are driven by these actuators 27 to move toward and away from the transport path. When one of the articles "w" is in the process of being packaged at the packaging position P, the braking stoppers 28 are used to arrest the transport of a next one of the articles "w" to be on standby.

As illustrated in FIG. 1, the film piece pressing mechanism 7 is disposed at a position in the upper direction of the packaging position P between the end of the article carry-in mechanism 1A and the beginning of the article carry-out mechanism 1B, and the film piece attaching mechanism 8 is disposed at a position below the packaging position P.

Figure 10:
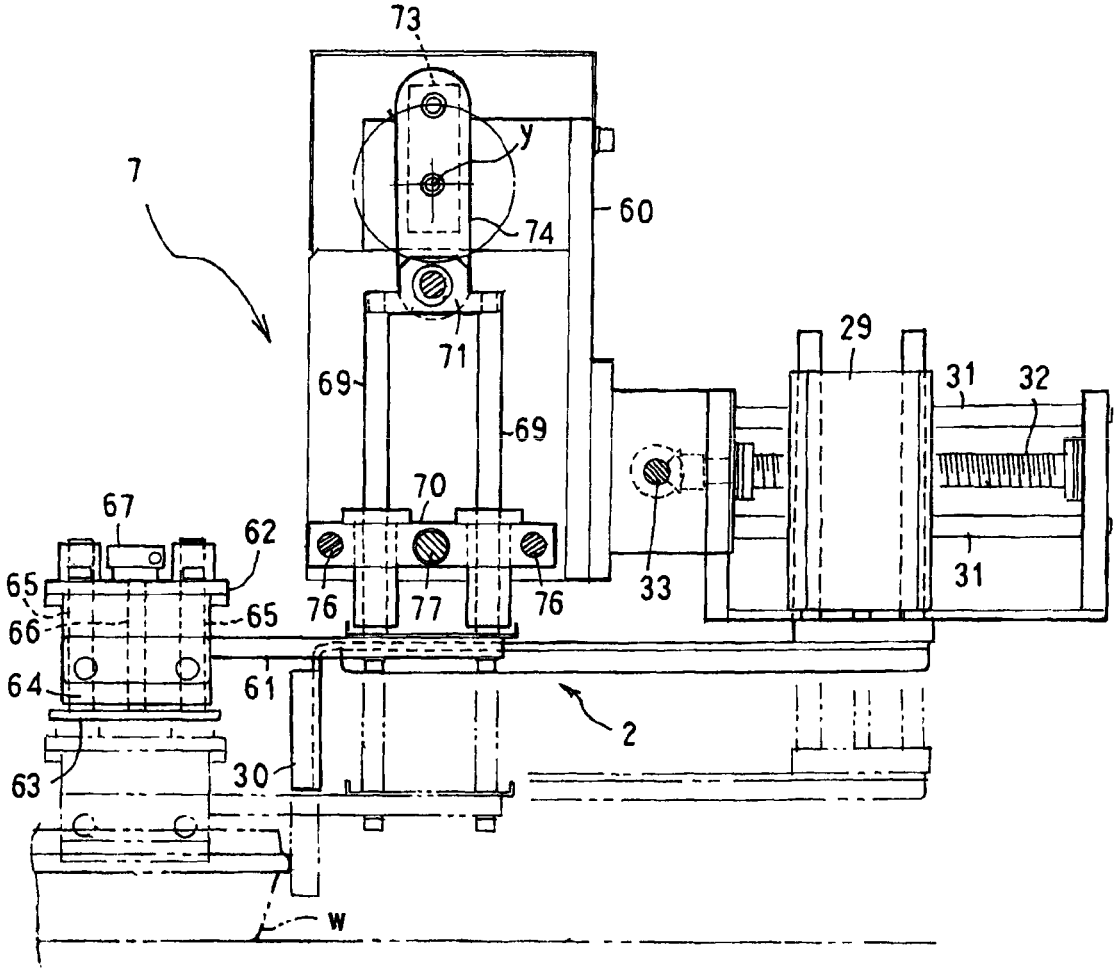
FIG. 10 is a side view illustrating the film piece pressing mechanism illustrated in FIG. 1.

As illustrated in FIG. 10, the article positioning mechanism 2 is mounted on the back side of a driving case 60 of the film piece pressing mechanism 7 described later. The article positioning mechanism 2 has a positioning stopper 30 at a position in the upper direction of the article carry-out mechanism 1B. The positioning stopper 30 is driven to move upward and downward by an actuator 29, an example of which is air cylinder.

The positioning stopper 30 has a front end that receives the article "w". This front end is horizontally extending forward from its base portion coupled to the actuator 29 and is bending downward. When the article "w" arrives at the packaging position P, the positioning stopper 30 moves downward onto the article transport path and receives an edge of the article "w" in the direction of transport. The positioning stopper 30, through this contact with the article "w", controls and maintains the position and direction of the article "w" in the direction of transport. The positioning stopper 30, by moving upward away from the article transport path, allows the article "w" to further travel in the direction of transport.

The actuator 29 that drives the positioning stopper 30 to move upward and downward is supported along upper and lower guiding shafts 31 in a manner that this actuator is allowed to move in opposite directions. Further, the actuator 29 is engaged with a threaded shaft 32 horizontally supported in the direction of transport. The threaded shaft 32 is interlocked, through a bevel gear, with an operating shaft 33 horizontally supported in the lateral direction. When the operating shaft 33 is rotated in forward and reverse directions by rotating an operating handle 33*a* disposed on the front side of the device illustrated in the plan view of FIG. 11, the actuator 29 is allowed to move on the threads in opposite directions. In this manner, the positioning stopper 30 is positionally adjustable in the direction of transport correspondingly to the length of the article "w" in the direction of transport, so that the center of the positioned article "w" in the direction of transport is coincident with the packaging position P.

As illustrated in FIGS. 1 and 2, the film feeder 3 has a roll support shaft 35 supported in a horizontally cantilevered manner to horizontally support a roll of raw film R in the lateral direction. A sheet of raw film F unwound from the roll of raw sheet R is guided on a predetermined path to the printing processor 4. A roll of raw film R' for backup is storable at a position in the upper direction of the film feeder 3.

Though not specifically illustrated in the drawings, the printing processor 4 has a thermal printer installed inside. This thermal printer is used to print various pieces of information inputted and set beforehand at predetermined positions on the upper surface of the sheet of raw film F. For example, the type, material(s) used, expiration date, price, and barcode of what is contained in the article "w" are printed at a constant pitch in the longitudinal direction of the sheet of raw film F.

Figure 6:
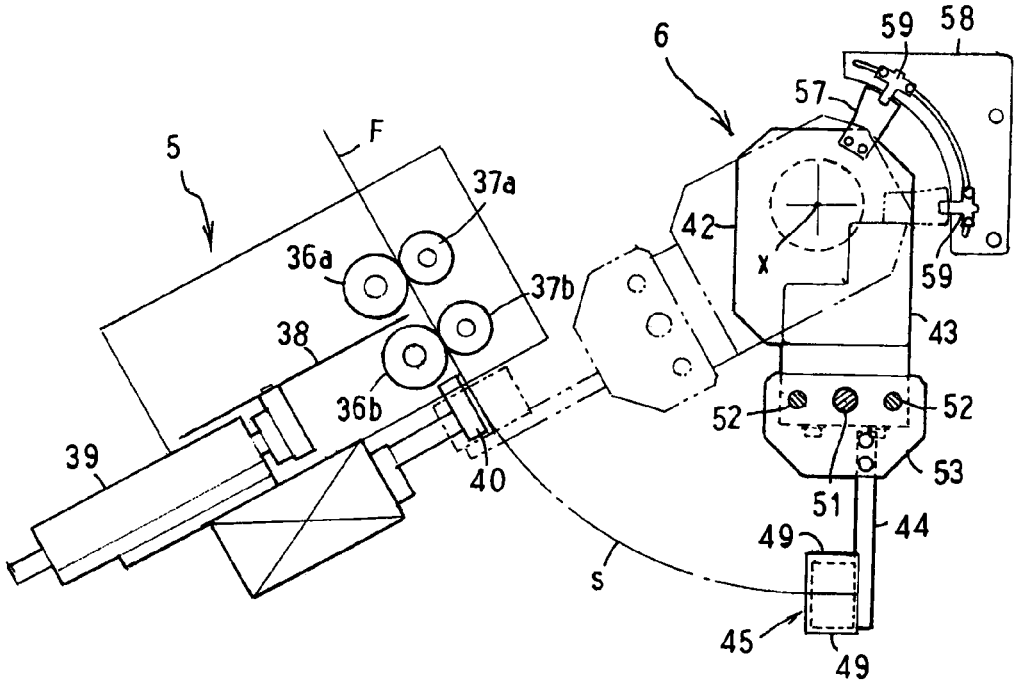
FIG. 6 is a side view illustrating a film piece former and a film piece transporting mechanism illustrated in FIG. 1.
Figure 8:
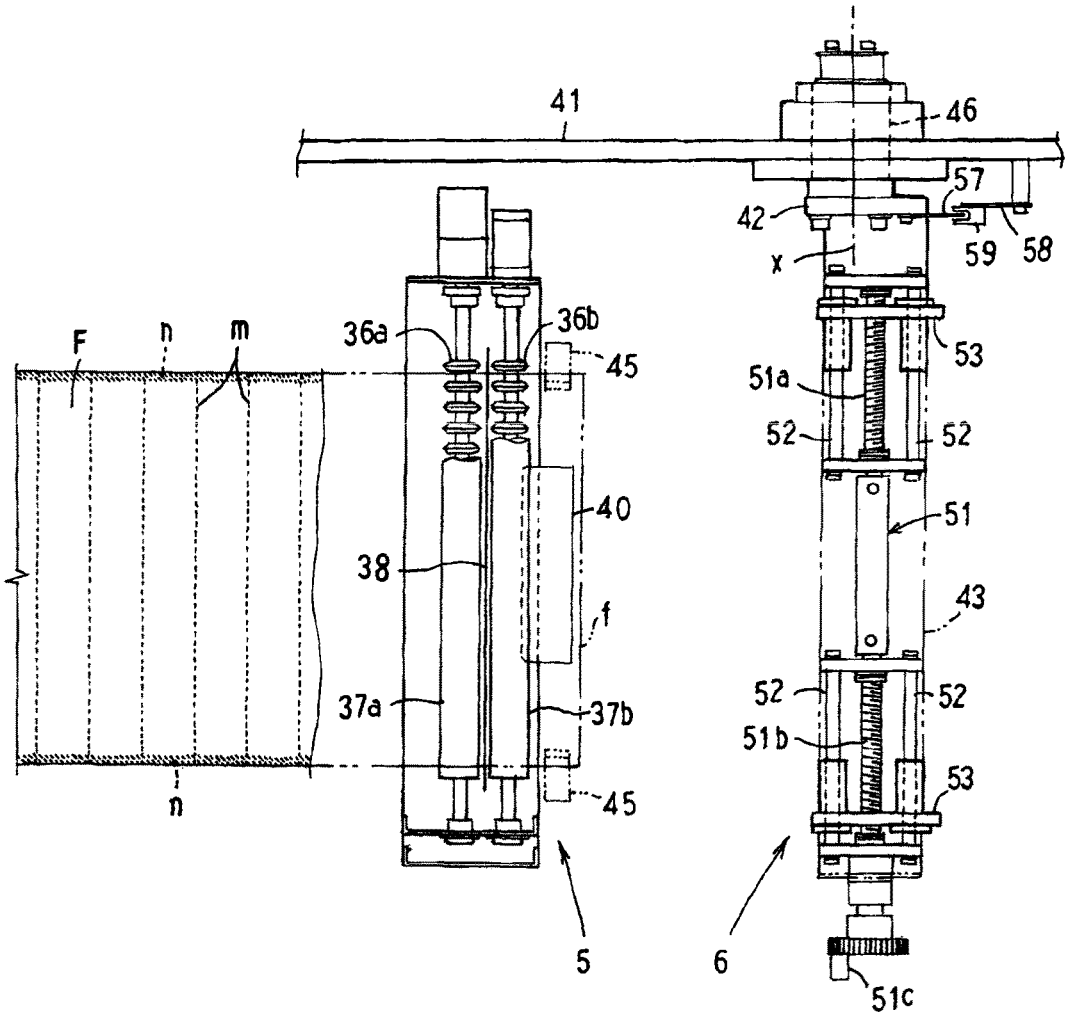
FIG. 8 is a transverse plan view illustrating the film piece former and the film piece transporting mechanism illustrated in FIG. 1.

As illustrated in FIGS. 6 and 8, the film piece former 5 has two motor-driven feeding rollers 36*a* and 36*b* and pushing rollers 37*a* and 37*b* that are disposed in a freely rotatable manner. The feeding rollers 36*a* and 36*b* are arranged in two rows and pivotally journaled horizontally in the lateral direction. The pushing rollers 37*a* and 37*b* are facing the feeding rollers 36*a* and 36*b* at positions in the upper direction of these feeding rollers. The film piece former 5 vertically holds and transports the sheet of raw film F using the feeding rollers 36*a* and 36*b* and the pushing rollers 37*a* and 37*b*. As illustrated FIG. 6, the film transport path in the film piece former 5 is inclined downward in a lateral view.

A cutter 38 greater in width than the sheet of raw film F is disposed at a position between and below the feeding lowers 36*a* and 36*b*. The cutter 38 is allowed to move upward and downward when driven by an actuator 39, an example of which is air cylinder. When the cutter 38 is elevated to a position higher than the film travelling path, the sheet of raw film F vertically held at two positions on its front and back sides is cut in the middle between these two positions. Thus, the sheet of raw film F is cut into pieces of band-shaped film "f".

The sheet of raw film F has lines of perforation "m" (see FIG. 8); cutting marks, formed at a pitch correspondingly to the length of the piece of film "f" from its front to back side. When it is detected by, for example, an optical sensor that the line of perforation "m" is located immediately above the cutter 38 currently at a position below the film traveling path, the film feed by the feeding rollers 36*a* and 36*b* is suspended, and the cutter 38 is elevated to cut the sheet of film. Thus, the film position is detected, the feeding rollers 36*a* and 36*b* are driven, and the cutter 38 is moved upward and downward in a coordinated manner for cutting purpose.

When the circumferential speed of the feeding roller 36*b* on the back side is set to a slightly lower speed than that of the feeding roller 36*a*, a suitable degree of tension may be imparted to a part of the film between these rollers to be cut by the cutter 38. This may be useful for the cutter 38 to precisely cut the film.

A backing plate 40 is disposed at a position on the film-outgoing side of the film piece former 5. The cut piece of film "f" transported being inclined obliquely downward is directly received and supported by the backing plate 40. The backing plate 40 has a lateral width smaller than the length of the piece of film "f" in the lateral direction. The transported piece of film "f" is, therefore, supported with its both ends hanging out from lateral sides of the backing plate 40.

Figure 7:
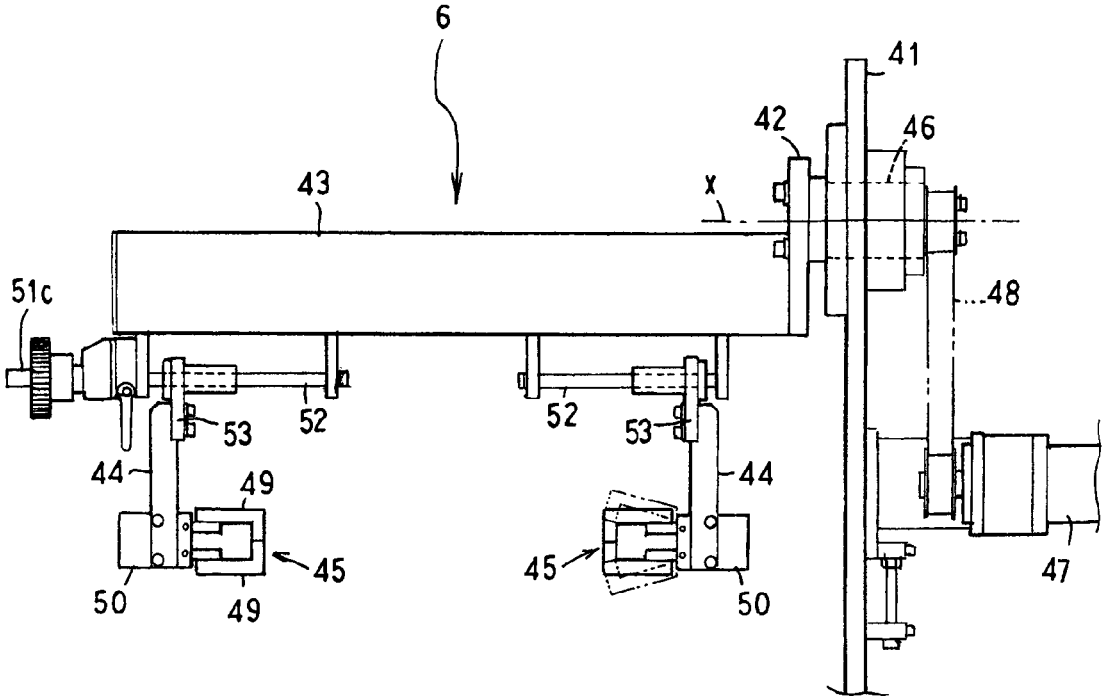
FIG. 7 is a rear view of the film piece transporting mechanism illustrated in FIG. 1.

FIGS. 6 to 8 illustrate structural details of the film piece transporting mechanism 6.

The film piece transporting mechanism 56 is fitted to and supported by a frame plate 41 disposed vertically upright on a lateral side of the article transport path. The film piece transporting mechanism 6 is equipped with a rotary member 42, a hollow support frame 43, a pair of left and right support arms 44, and chucking mechanisms 45. The rotary member 42 is rotatable in reciprocating motion around an axis "x" horizontally extending from one side to the other perpendicularly to the frame plate 41. The support frame 43 is coupled to the rotary member 42 and is extending in a horizontally cantilevered manner in the lateral direction. The support arms 44 are extending downward from the support frame 43. The chucking mechanisms 45; an example of the film piece holding mechanism, are mounted to lower parts of the respective support arms 44.

A support shaft 46 is integrally coupled to the rotary member 42. The support shaft 46 is penetrating through the frame plate 41 and protruding on the backside of the frame plate 41. A transmission belt 48 is wound around the support shaft 46 and a reducer-attached motor 47 mounted on the back side of the frame 41 to allow the support shaft 46 and the motor 47 to interlock with each other. As the motor 47 is rotated in forward and reverse directions, the chucking mechanisms 45 are moved along an arc-shaped trajectory "s" centered on the axis "x" to and from respective upper positions for receiving the piece of film and lower positions for feeding the piece of film.

The chucking mechanisms 45 are mounted to inner edges of the support arms 44 in a manner that they are directed inward facing each other. The chucking mechanisms 45 each have a pair of nipping claws allowed to open and close through an oscillatory motion, and a driving case 50 that drives the nipping claws 49 to open and close using an actuator installed inside such as a motor or an electromagnetic solenoid. The rotary member 42 is rotated upward to move the chucking mechanisms 45 to the respective film piece receiving positions near the back side of the film piece former 5. The nipping claws 49 of the chucking mechanisms 45 are thus allowed to hold both ends of the piece of film "f" inclining obliquely downward and supported on the backing plate 40 of the film piece former 5.

The rotary member 42 are rotated downward to move the chucking mechanisms 45 to the respective film piece feeding positions immediately below, and the nipping claws 49 of the chucking mechanisms 45 are opened to release the piece of film "f" on the article "w" currently at the packaging position P.

When the chucking mechanisms 45 are located at the respective film piece receiving positions, film-catching surfaces of the nipping claws 49 are inclined obliquely downward in the same manner as the piece of film "f" on the support plate 40 of the film piece former 5. When the chucking mechanisms 45 are located at the respective film piece feeding positions, the film-catching surfaces of the nipping claws 49 are horizontally positioned along the direction of transport. The piece of film "f" thus horizontally held by and released from the opened nipping claws 49 are carried onto the upper surface of the article "w".

The nipping claws 49 of the chucking mechanisms 45 are opened, i.e., the piece of film "f" thereby held is released, after the piece of film "f" on the article "w" at the packaging position P is pressed against the upper surface of the article "w" by upper surface pressing members 63, which will be described later, of the film piece pressing mechanism 7. The piece of film "f", after being carried onto the article "w" by the film piece transporting mechanism 6, is released being pushed against a predetermined part of the upper surface of the article "w".

A detection piece 57 is mounted to the rotary member 42. An optical sensor 59 is fitted to the support plate 58 mounted to the frame plate 41. The optical path of the optical sensor 59 is blocked by the detection piece 57. The motor 47 is driven in response to the rotation of the rotary member 42 being detected by the detection piece 57. The movable ranges and stop positions of the chucking mechanisms 45 are thus controllable.

The piece of film "f" has starched parts "n" (see FIG. 8) at ends on both sides on its back surface. The nipping claws 49 respectively have hook-shaped edges; nippers, that allow the chucking mechanisms 45 to nip inner parts of the piece of film "f" than the starched parts "n". On the inner back side of the nippers of the closed nipping claws 49 is some space that invites the ends of the piece of film "f". Further, positions of the chucking mechanisms 45 in the lateral direction need to be adjusted for the device to accept various pieces of films "f" that differ in width in the lateral direction. To this end, the device includes the following technical features.

In the support frame 43 extending from the rotary member 42 and supported in a horizontally cantilevered manner in the lateral direction, an operating shaft 51 is horizontally supported in the lateral direction along the whole length of the support frame 43, and left and right guiding shafts 52 are disposed in two pairs at positions on the front and back sides of the operating shaft 51, as illustrated in FIG. 8. The guiding shafts 52 are respectively inserted through the movable frames 53 to which the support arms 44 are coupled, and the movable frames 53 are supported in a manner that they are movable in the lateral direction along the guiding shafts 52. The operating shaft 51 is inserted through and engaged with the movable frames 53.

The operating shaft 51 has a left threaded shaft portion 51*a* and a right threaded shaft portion 51*b* having opposing lead angles. The operating shaft 51 is rotatable by manipulating a handle 51 disposed at one end of this operating shaft. The left threaded shaft portion 51*a* and the right threaded shaft portion 51*b* are respectively inserted through and engaged with the movable frames 53. By rotating the operating shaft 51 in forward and reverse directions, the movable frames 24*a* and 24*b* are equally movable toward and away from each other, providing an adjustable interval between the chucking mechanisms 44. Then, the chucking mechanisms 41 are allowed to nip suitable parts of the piece of film "f" correspondingly to the length of the piece of film "f" in the lateral direction.

The frame plate 41 mounted with the film piece transporting mechanism 6 is supported by a device frame 54 (see FIG. 2) in a manner that this frame plate is movable upward and downward through a pair of vertical rails 55 disposed at positions forward and rearward in the direction of transport. When a threaded shaft 56 is moved in forward and reverse directions by manipulating a handle 56*a* disposed at an upper end of this threaded shaft, the frame plate 41 is allowed to move on the threads upward and downward. Thus, the height of the film feeding position in the film piece transporting mechanism 6 is suitably adjustable in accordance with the height of the article "w". The printing processor 4 and the film piece former 5 are also supported by the frame 41. Any change of the height of the frame plate 41 does not affect relative positions of the film piece former 5 and the film piece transporting mechanism 6, allowing the piece of film to be received as expected from the film piece former 5.

Figure 9:
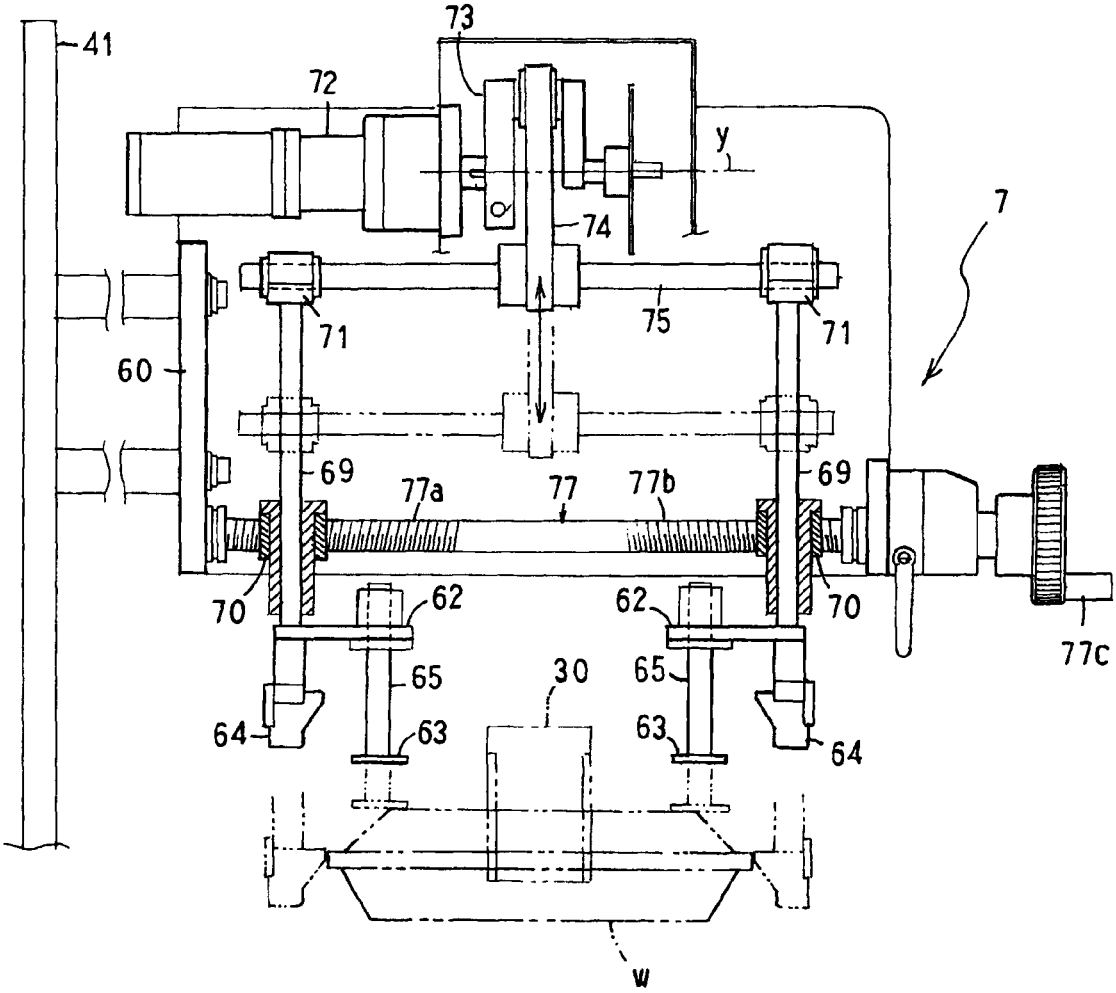
FIG. 9 is a front view illustrating a film piece pressing mechanism illustrated in FIG. 1.
Figure 11:
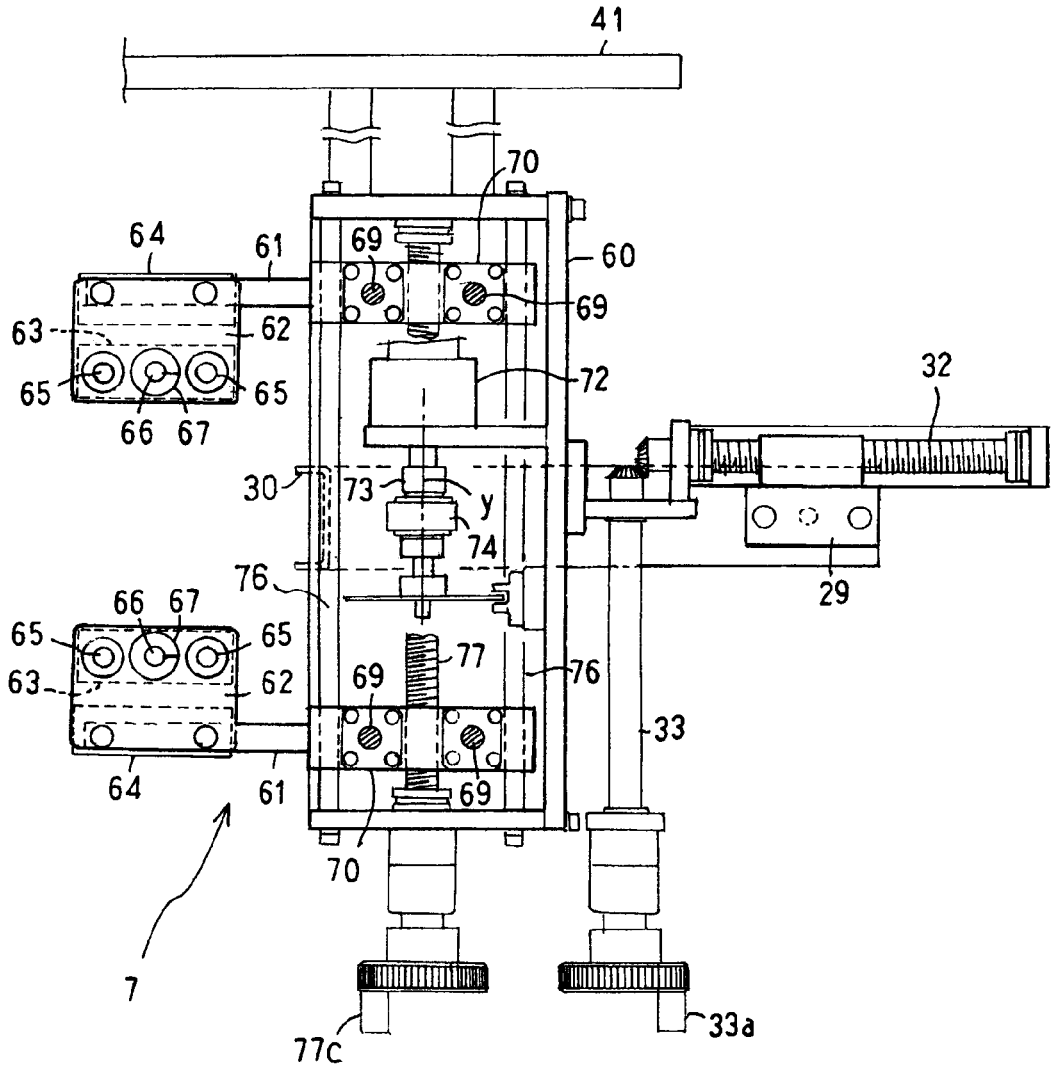
FIG. 11 is a plan view illustrating the film piece pressing mechanism illustrated in FIG. 1.

FIGS. 9 to 11 illustrate detailed structural features of the film piece pressing mechanism 7 disposed at a position in the upper direction of the packaging position P.

The film piece pressing mechanism 7 has a driving case 60 coupled to the frame plate 41, and a pair of left and right support arms 61. The support arms 61 are driven by a driving means installed inside to move upward and downward at positions below the driving case 60. The film piece pressing mechanism 7 further has support brackets 62 coupled to front ends of the support arms 61, and upper surface pressing members 63 and lateral side pressing members 64 mounted to and supported by the support brackets 62.

The upper surface pressing members 63 each have a flat plate-like shape and are used to press the piece of film "f" on the article "w" at the packaging position P against the upper surface of this article.

A pair of guiding shafts 65 are disposed vertically upright at positions forward and rearward in the direction of transport of the upper surface pressing member 61. A braking shaft 66 is disposed vertically upright at a middle position in the direction of transport. The guiding shafts 65 and the braking shaft 66 are inserted through a support bracket 62 in a manner that these shafts are slidable upward and downward, and the upper surface pressing member 63 is slidable downward under its own weight. A downward movement preventive collar 67 is anchored to an upper protruding end of the braking shaft 66 to allow the upper surface pressing member 63 to move downward under its own weight until the downward movement preventive collar 67 contacts the upper surface of the support bracket 62.

The lateral side pressing members 64 are used to press parts of the piece of film "f" downward that are hanging out from the left and right sides and to fold the pressed parts further downward along lateral sides of the article "w". The lateral side pressing members 64 are formed in a block-like shape, and inner surfaces of these members are bending downward. The lateral side pressing member 64 is coupled to a lower part of the support bracket 62.

In the support arms 61, the support brackets 62 are coupled to parts on the front side, and parts on the back side are coupled to lower ends of a pair of slidable support shafts 69 disposed at positions forward and rearward in the direction of transport. The slidable support shafts 69 are inserted through and supported by movable tables 70. The movable tables 70 are mounted to a lower part of the driving case 60 in a laterally movable manner. The slidable support shafts 69 are supported by the movable tables 70 in a vertically slidable manner. The slidable shafts 69 are allowed to slide upward and downward. Upper ends of the slidable shafts 69 are coupled to movable blocks 71.

A crank arm 73 is disposed in an upper part of the driving case 60. The crank arm 73 is driven by a reducer-attached motor 72 to rotate around a laterally horizontal fulcrum "y". An upper end 74 of an operating link 74 is pivotally coupled to a free end of the crank arm 73. A vertically movable shaft 75 is horizontally penetrating through and fixed to a lower end of the operating link 74 in the lateral direction. The movable blocks 71 are loosely fitted to and supported by the vertically movable shaft 75 in a manner that these movable blocks are slidable in the lateral direction.

When the crank arm 73 is rotated around the fulcrum "y", the vertically movable shaft 75 moves upward and downward. Then, the movable blocks 71, slidable support shaft 69, and support arms 61 supported by the vertically movable shaft 75 are moved upward and downward altogether, and the upper surface pressing members 63 and the lateral side pressing members 64 coupled to the front ends of the support arms 61 through the support brackets 62 are correspondingly moved upward and downward at a certain stroke.

An interval between the upper surface pressing members 63 and between the lateral side pressing members 64 on the left and right sides is suitably adjustable in accordance with the width of the article "w" in the lateral direction. An operating shaft 77 and a pair of guiding shafts 76 disposed at positions forward and rearward in the direction of transport are horizontally supported in the lateral direction in a lower part of the driving case 60. The guiding shafts 76 are inserted through the movable tables 70 to support and guide the movable tables 70 in a laterally movable manner along the guiding shafts 76. The operating shaft 77 is inserted through and engaged with the movable tables 70.

The operating shaft 77 has a left threaded shaft portion 77*a* and a right threaded shaft portion 77*b*. The operating shaft 77 is rotatable by manipulating a handle 77*c* disposed at one end of this operating shaft. These threaded shaft portion 77*a* and threaded shaft portion 77*b* are inserted through and engaged with the respective movable frames 71. When the operating shaft 77 is rotated in forward and reverse directions, the movable tables 71 move toward and away from each other, providing an adjustable interval between the upper surface pressing member 63 and the lateral side pressing member 64 respectively on the left and right sides.

The driving case 60 of the film piece pressing mechanism 7 is also mounted to the frame plate 41. By adjusting the vertical position of the frame plate 41, the height of the film piece pressing mechanism 7 is suitably adjustable correspondingly to the height of the article "w", as in the case of the printing processor 4, film piece former 5, and film piece transporting mechanism 6. As the frame plate 41 is vertically adjusted in position, the article positioning mechanism 2 moves upward and downward, and the height of the positioning stopper 30 is accordingly adjustable.

Figure 12:
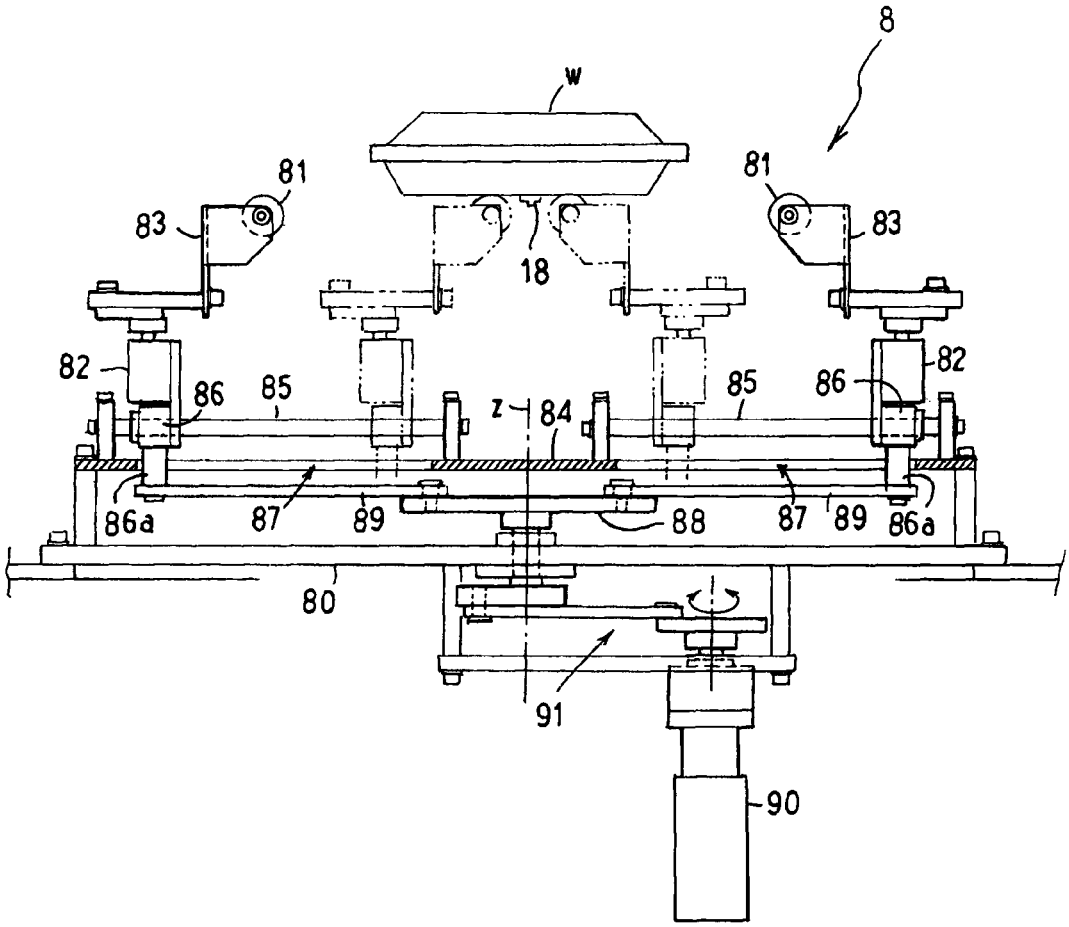
FIG. 12 is a front view illustrating a film piece attaching mechanism illustrated in FIG. 1.
Figure 13:
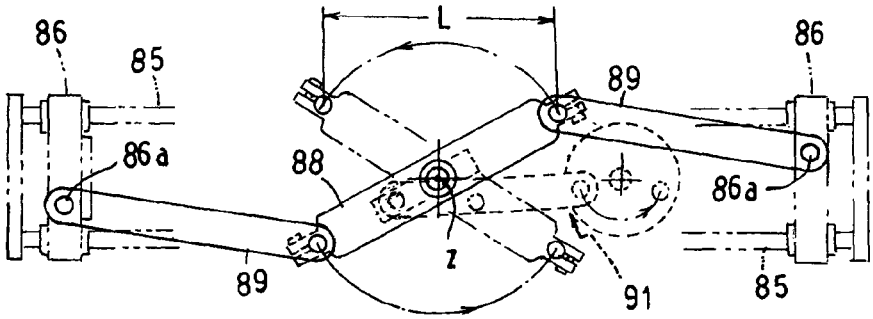
FIG. 13 is a plan view illustrating in part a driving means of the film piece attaching mechanism of FIG. 1
Figure 14:
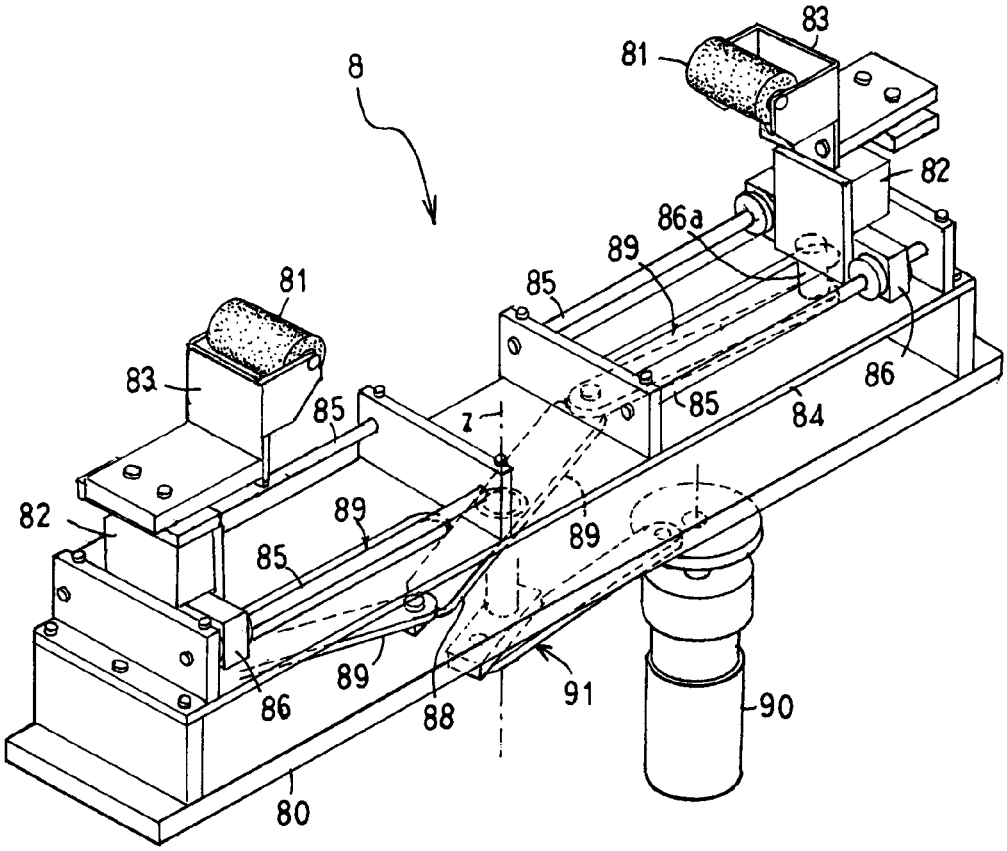
FIG. 14 is a perspective view illustrating the film piece attaching mechanism illustrated in FIG. 1.

FIGS. 12 to 14 illustrate detailed structural features of the film piece attaching mechanism 8 disposed at a position below the packaging position P.

The film piece attaching mechanism 8 is mounted to a support frame 80 disposed at a lower position in a space formed between the end of the article carry-in mechanism 1A and the beginning of the article carry-out mechanism 1B. The film piece attaching mechanism 8 has a pair of left and right attaching members 81 movable leftward, rightward, upward and downward, and a driving means that drives these members to move in the lateral direction.

The attaching members 81 each include an elastic roller. The surface of the roller is covered with a piece of rubber or sponge having a suitable degree of elasticity. The attaching members 81 are mounted to support brackets 83 in a freely rotatable manner. The support brackets 83 are driven to move upward and downward by actuators 82, an example of which is air cylinder or electromagnetic solenoid. Left and right guiding shafts 85 are fixedly disposed in two pairs, with a support table 84 interposed therebetween, at positions on the front and back sides in the upper direction of the support frame 80. Movable tables 86 are mounted to the pairs of guiding shafts 85 in a laterally slidable manner, and the actuators 82 are supported by the movable tables 86.

Support shafts 86*a* extending downward from the movable tables 86 are inserted through elongated holes 87 formed on the left and right sides of the support table 84. A driving arm 88 is disposed at a laterally central position of the support frame 80. The driving arm 88 is allowed to rotate around a vertical fulcrum "z". Ends of the driving arm 88 on both sides are pivotally coupled to the support shafts 86*a* through a push-pull link 89. The driving arm 88 is interlocked, through a crank linkage mechanism 91, with a reducer-attached motor 90 disposed at a position below the support frame 80. When the driving arm 88 is oscillated back and forth through a predetermined angle smaller than 180 degrees, the movable tables 86 move toward and away from each other at a predetermined stroke.

When the movable tables 86 are at standby positions away from each other, the attaching members 81 have been elevated to and are staying at a film piece-attachable height corresponding to a level of height of the transported article "w". When the movable tables 86 move toward each other and are staying at positions for attaching the piece of film, the attaching members move to underneath the article "w", and then elastically contact the bottom surface of the article "w" under a suitable pressure.

The banding and packaging device according to this embodiment is configured as described thus far. Next, steps of banding and packaging an article carried out by this device are hereinafter described referring to FIGS. 15 to 20.

1) Before the article "w" transported by the article carry-in mechanism 1A arrives at the packaging position P, the chucking mechanisms 45 of the film piece transporting mechanism 6 are on standby, holding near-end parts of the piece of film "f" using the nipping claws 49 at the film piece receiving positions ahead in the upper direction of the packaging position P. Further, the positioning stopper 30 of the article positioning mechanism 2 on the article carry-out mechanism 1B has moved downward to a lower position.

When it is detected by, for example, an optical sensor that the article "w" transported by the article carry-in mechanism 1A has passed a predetermined position, the support arms 44 oscillate obliquely downward toward the rear side, and the chucking mechanisms 45 move downward to the film piece feeding positions. Immediately before the chucking mechanisms 45 arrive at the film piece feeding positions, the transported article "w" is received by the positioning stopper 30 and thereby located at the packaging position P. Then, the transport of the article "w" by the belt conveyers of the article carry-out mechanism 1B and the relaying mechanism 1C is temporarily suspended. When it is detected that one of the articles "w" has passed the predetermined position, the braking stoppers 28 of the article carry-in mechanism 1A advance onto the article transport path to prevent further transport of the other articles "w" that follow.

Figure 15:
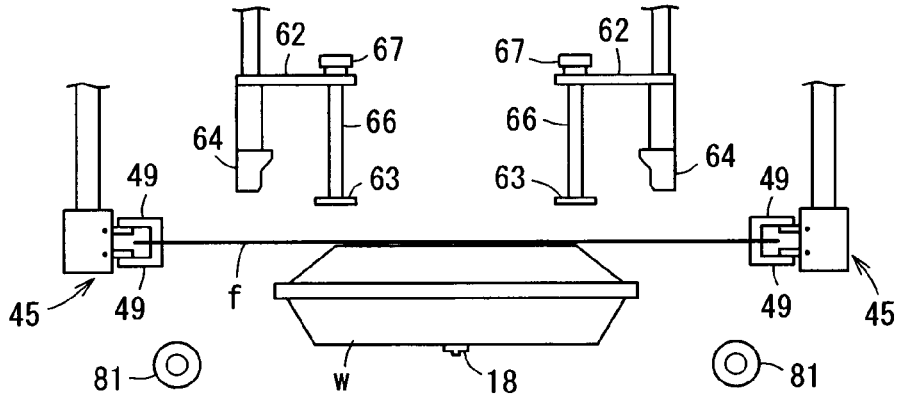
FIG. 15 is a front view illustrating a banding and packaging step.
Figure 16:
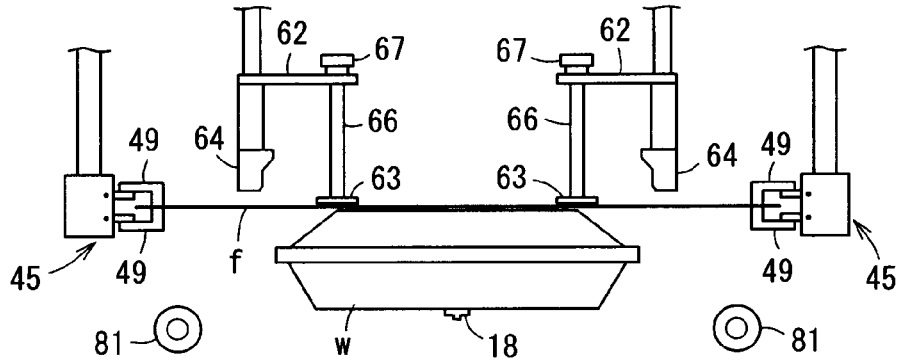
FIG. 16 is a front view illustrating a banding and packaging step.

2) When the article "w" is thus stopped at the packaging position P, and the chucking mechanisms 45 holding the piece of film "f" arrive at the film piece feeding positions, as illustrated in FIG. 15, the film piece pressing mechanism 7 is activated. Subsequent to the initial downward movement of the support brackets 62 of the film piece pressing mechanism 7, the upper surface pressing members 63 contact two parts of the piece of film "f" in the lateral direction. Then, the upper surface pressing members 63, under their own weight, lightly press the piece of film "f" against upper edges of the article "w". In response to the piece of film "f" being lightly pressed by the upper surface pressing members 63, the nipping claws 49 of the chucking mechanisms 45 release the piece of film "f". As a result, the piece of film "f" is pushed by the upper surface pressing members 63 against the upper surface of the article "w" currently at the packaging position P, specifically, in a near-center part on the upper surface in the direction of transport, while both end sides of the piece of film "f" are free and left untouched.

The film piece pressing mechanism 7 is thus allowed to lightly press the piece of film "f" against the upper surface of the article "w" under the weight of the upper surface pressing members 63. This may prevent that a pressing force to be applied to the article "w" becomes variable; too strong or too weak, depending on the height of the article "w". Thus, the piece of film "f" may be pressed under a constant pressing force against the upper surface of the article "w".

In case the article "w" is relatively short in the direction of transport, the article "w" on the narrow transport belt 18 of the relaying mechanism 1C may lose balance in the direction of width. When two parts of the piece of film "f" in the lateral direction are pushed against the upper surface of the article "w" by the upper surface pressing members 63 of the film piece pressing mechanism 7 to release the piece of film "f" from the nipping claws 49 of the chucking mechanisms 45, the article "w" is supported at three points, specifically, a center part of the bottom surface is supported by the transport belt 18, and lateral two parts of the upper surface are supported by the upper surface pressing members 63. The article "w" may be thus stably retained in a well-balanced manner and then subjected to the packaging process.

Figure 17:
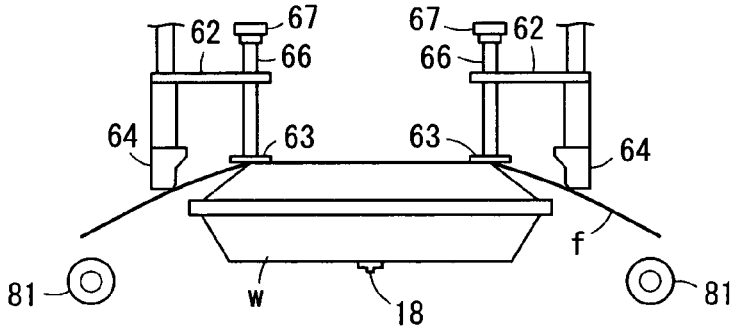
FIG. 17 is a front view illustrating a banding and packaging step.
Figure 18:
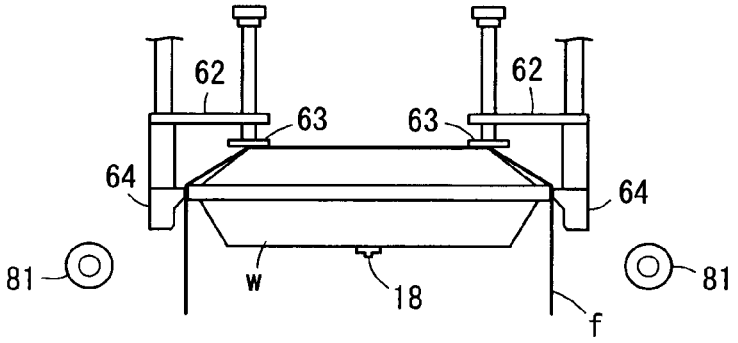
FIG. 18 is a front view illustrating a banding and packaging step.

3) Along with the downward movement of the support brackets 62, the lateral side pressing members 64 move downward, with the piece of film "f" being pushed against the upper surface of the article "w" under the weight of the upper surface pressing members 63, as illustrated in FIG. 17. At the time, the lateral side pressing members 64 alone move downward to certain positions, and lateral ends of the piece of film "f" hanging out from both sides of the article "w" are pushed downward and then pushed further downward along shoulder parts and lateral surfaces of the article "w", as illustrated in FIG. 18.

The support arms 44 of the chucking mechanisms 45 that released the piece of film "f" held by the nipping claws 49 oscillate forward and upward, moving back to the film piece receiving positions. When it is detected by, for example, an optical sensor that the article "w" transported by the article carry-in mechanism 1A passed a predetermined position, the film piece former 5 is driven to feed a piece of film "f" onto the backing plate 40.

Figure 19:
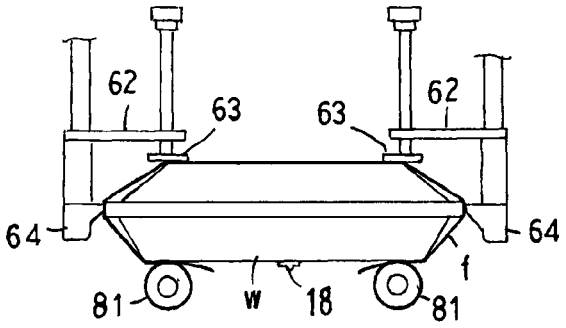
FIG. 19 is a front view illustrating a banding and packaging step.
Figure 20:
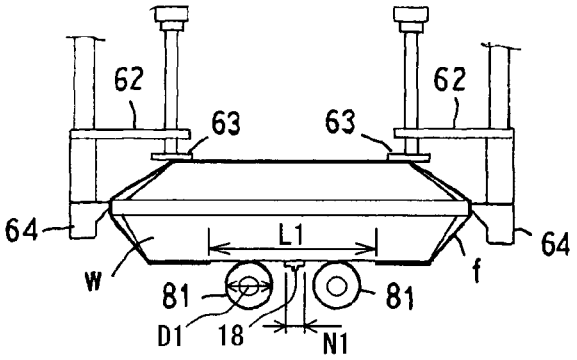
FIG. 20 is a front view illustrating a banding and packaging step.

4) As illustrated in FIGS. 19 and 20, the film piece attaching mechanisms 8 are then driven, and the attaching members 81 at laterally outward standby positions underneath the article transport path are moved horizontally to the film piece attaching positions below the article "w". Then, the piece of film "f" drooping down from the article "w" is pressed by the attaching members 81 and wound around the bottom surface of the article "w", and the starched parts "n" at both ends of the piece of film are elastically pressed against and attached to the bottom surface of the article "w".

As illustrated in FIG. 20, transport belt 18 of the relaying mechanism 1C has a width small enough to avoid any interference with the attaching members 81 when these attaching members are moving to the film piece attaching positions underneath the article "w" and are attaching the lateral sides of the piece of film "f" to the bottom surface of the article "w".

Figure 21:
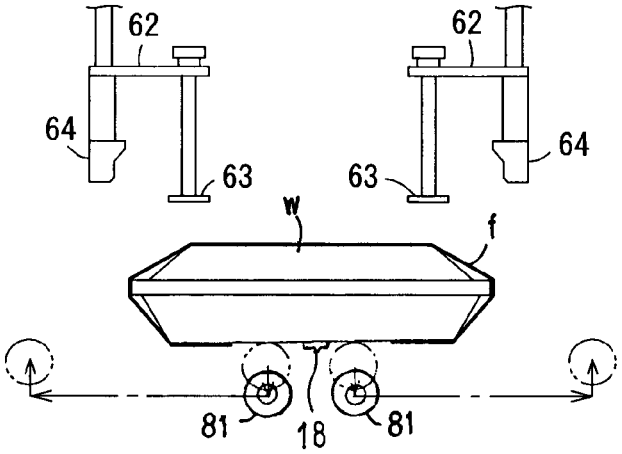
FIG. 21 is a front view illustrating a banding and packaging step.

5) When the piece of film "f" is wound around and attached to the article "w", the attaching members 81 are slightly pulled down from the current positions by the actuators 82 to depart from the bottom surface of the article "w", as illustrated in FIG. 21. Then, the attaching members 81 recede laterally outward without touching the attached piece of film "f". The attaching members 81 at the standby positions are elevated to the former positions by the actuators 82.

Figure 22:
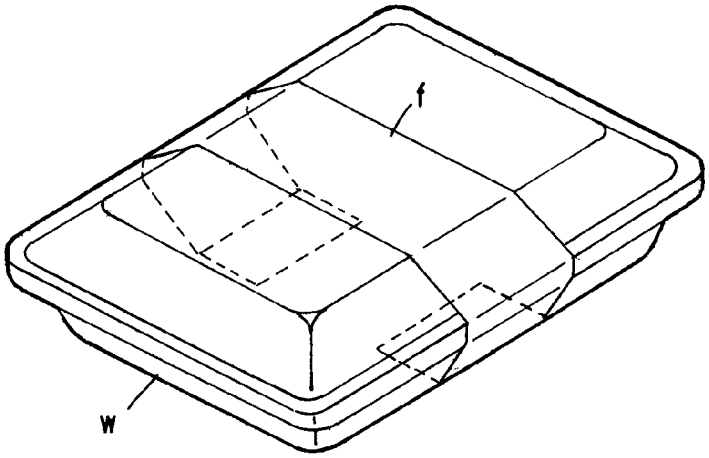
FIG. 22 is a perspective view of a packaged article wound with a piece of film.
Figure 23:
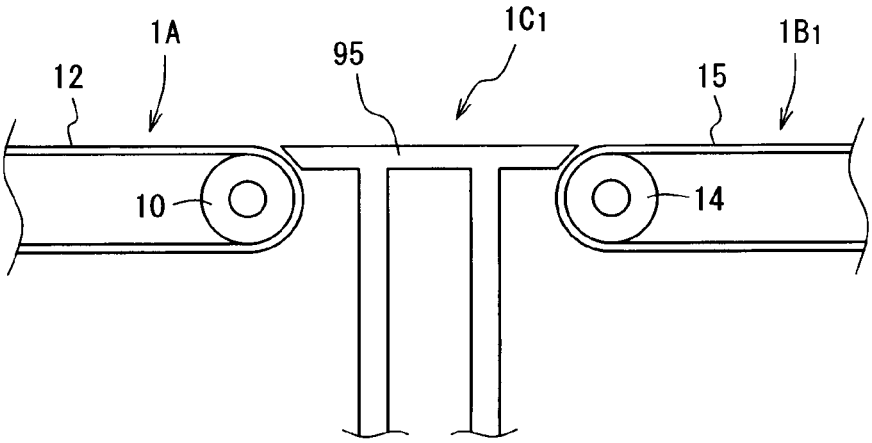
FIG. 23 is a schematic side view illustrating a relaying mechanism according to another embodiment of the present invention.
Figure 24:
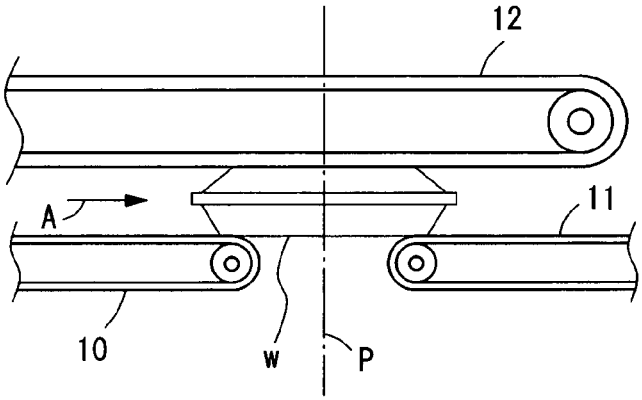
FIG. 24 is a side view illustrating transport of an article in a banding and packaging device of the known art.
Figure 25:
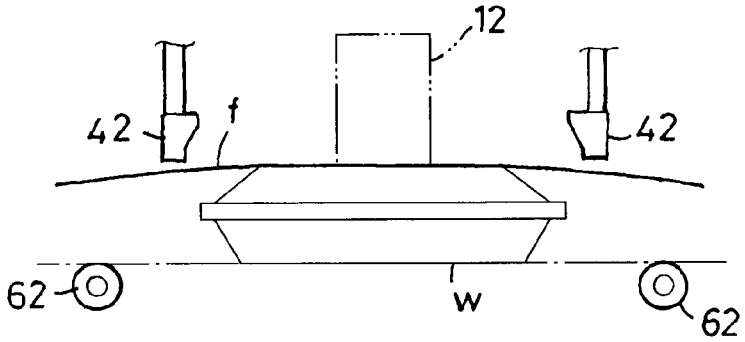
FIG. 25 is a front view illustrating a banding and packaging step of the known art.
Figure 26:
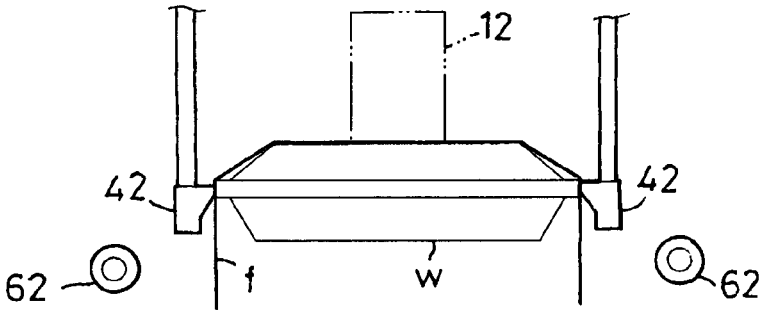
FIG. 26 is a front view illustrating a banding and packaging step of the known art.
Figure 27:
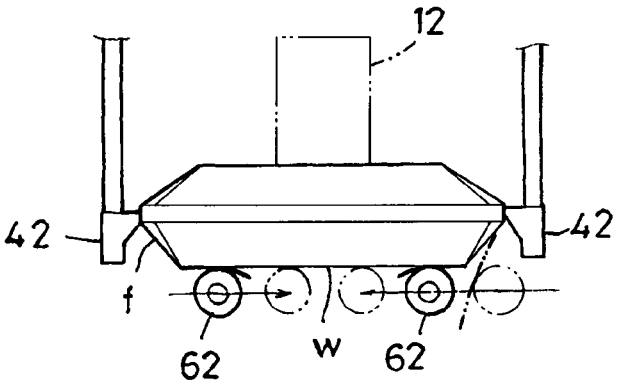
FIG. 27 is a front view illustrating a banding and packaging step of the known art.

6) When the piece of film "f" is successfully wound around and attached to the article "w", the positioning stopper 30 on the article carry-out transporting mechanism 1B starts to recede upward. Then, the packaged article "w" (see FIG. 22) starts to be transported rearward again by the belt conveyers of the article carry-out mechanism 1B and of the relaying mechanism 1C. At the same time, the braking stoppers 28 of the article carry-in mechanism 1A recede from the article transport path, and another piece of article "w" to be packaged is transported to the packaging position P. The positioning stopper 30 on the article carry-out transporting mechanism 1B is moved downward again after the packaged article "w" is transported away.

Thus far was described one round of the banding and packaging steps, which is repeatedly carried out for each new article "w" to be packaged.

According to this embodiment, the relaying mechanism 1C receives and supports the transported article "w" from below at the packaging position P between the article carry-in mechanism 1A and the article carry-out mechanism 1B. Then, an edge of the article "w" being transported by the article carry-in mechanism 1A may be prevented from getting caught in between the article carry-in mechanism 1A and the article carry-out mechanism 1B. This may allow smooth transport of the article "w" onto the article carry-out mechanism 1B without having to vertically hold the articles as in the known art. The upper transport belt 12 of the known art, as illustrated in FIGS. 24 to 27, may become unnecessary.

The relaying belt conveyer of the relaying mechanism 1C used to transport the article "w" may ensure smooth transport of the article "w", if relatively short in the direction of transport, to and from the packaging position P.

The relatively small transport belt 18 in width of the relaying mechanism 1C is used to receive and support the article "w" at its center part in the direction of width. Such a small width of the transport belt 18 may avoid interference with the attaching members 81 of the film piece attaching mechanism 8 when these attaching members are moving to underneath the article "w" and winds both ends of the piece of film "f" around the bottom surface of the article "w".

Another Embodiment

The present invention may be feasible in the following manner.

1) The relaying mechanism 1C may be driven independently from the article carry-out mechanism 1B. In this instance, the relaying belt conveyer of the relaying mechanism 1C may be deactivated during the ongoing banding and packaging steps, and the relaying belt conveyer of the relaying mechanism 1C and the carry-out belt conveyer of the article carry-out mechanism 1B may be synchronously driven when the banding and packaging steps are over.

2) In case target articles to be packaged by the device are limited to articles "w" greater in length in the direction of transport than any gap between the end of the belt conveyer of the article carry-in mechanism 1A and the beginning of the belt conveyer of the article carry-out mechanism 1B, the articles "w" are supported all the way from the end of the belt conveyer of the article carry-in mechanism 1A to the beginning of the belt conveyer of the article carry-out mechanism 1B. In this instance, a relaying mechanism $\mathbf{1}C_1$ including a relaying support table 95 small in width, which serves to prevent the articles "w" from getting caught in the inter-mechanism gap, may be fixedly disposed at a laterally central position between the end of the transport belt 10 of the article carry-in mechanism 1A and the beginning of the transport belt 15 of an article carry-out mechanism $\mathbf{1}B_1$.

3) The article carry-in mechanism 1A and the article carry-out mechanism 1B may include multiple transport belts small in width that are arranged next to one another at small intervals along the width of direction.

REFERENCE SIGNS LIST

1A article carry-in mechanism
1B article carry-out mechanism
1C relaying mechanism
2 article positioning mechanism
6 film piece transporting mechanism
7 film piece pressing mechanism
8 film piece attaching mechanism
18 transport belt
62 support bracket
63 upper surface pressing member
64 lateral side pressing member
F piece of film
P packaging position
W article

The invention claimed is:

1. A banding and packaging device, comprising:

an article carry-in mechanism that includes a first transport belt and that horizontally transports an article in a transport direction of the article to a packaging position behind a current position of the article by the first transport belt;

a film piece transporting mechanism that transports a piece of film formed in a band shape onto the article at the packaging position;

a film piece pressing mechanism that presses the piece of film on the article against the article at the packaging position and that further presses ends of the piece of film on both sides thereof downward;

a film piece attaching mechanism that winds the piece of film around a bottom surface of the article and that attaches the ends pressed downward by the film piece pressing mechanism to the bottom surface;

an article carry-out mechanism that includes a second transport belt and that horizontally transports the article to a rear of the current position of the article from the packaging position by the second transport belt, the article wound with the piece of film, with the ends of the piece of film being attached to the bottom surface, a beginning of the second transport belt facing an end of the first transport belt with an interval between the beginning of the second transport belt and the end of the first transport belt that is greater than a front-rear width of the piece of film in the transport direction of the article; and a relaying mechanism that receives and supports the article being transported from below at a position in the interval and that relays transportation of the article between the end of the first transport belt of the article carry-in mechanism and the beginning of the second transport belt of the article carry-out mechanism, wherein:

the packaging position is located in the interval between the article carry-in mechanism and the article carry-out mechanism, and the relaying mechanism receives and supports the article in a center part of the article at the packaging position in a direction of width of the article orthogonal to the transport direction of the article, whereby, in the received and supported state of the article on the relaying mechanism, an open space is provided within the interval in the transport direction of the article and around the article except below the bottom surface of the article at the center part of the article in the direction of width of the article.

2. The banding and packaging device according to claim 1, wherein:

the relaying mechanism comprises a relaying belt conveyer that transports the article, and the relaying belt conveyer comprises a transport belt small in width that supports the center part in the direction of width.

3. The banding and packaging device according to claim 2, wherein:

the article carry-out mechanism comprises a carry-out belt conveyer, the carry-out belt conveyer comprising a first rear driving pulley, a first front driven pulley and the second transport belt, the second transport belt being wound around the first rear driving pulley and the first front driven pulley; and the transport belt small in width is wound around the first front driven pulley of the carry-out belt conveyer to have the relaying belt conveyer be driven by the carry-out belt conveyer.

4. The banding and packaging device according to claim 3, wherein:

the article carry-in mechanism comprises a carry-in belt conveyer, the carry-in belt conveyer comprising a second rear driving pulley, a second front driven pulley and the first transport belt, the first transport belt being wound around the second rear driving pulley and the second front driven pulley; and a support plate that receives and supports the article from below is disposed between the carry-in belt conveyer and the relaying belt conveyer.

5. The banding and packaging device according to any one of claims 2 to 4, wherein:

the film piece pressing mechanism comprises:

an upper surface pressing member that presses, under its own weight, the piece of film against an upper surface of the article; and lateral side pressing members that press both end sides of the piece of film downward along lateral surfaces of the article after the piece of film is pressed against the upper surface by the upper surface pressing member.

6. The banding and packaging device according to claim 5, wherein:

the film piece pressing mechanism comprises a support bracket allowed to move upward and downward, the lateral side pressing members are immovably coupled to the support bracket, the upper surface pressing member is supported by the support bracket in a vertically movable manner under its own weight, and the upper surface pressing member approaches the upper surface of the article earlier than the lateral side pressing members in response to the downward movement of the support bracket.

7. The banding and packaging device according to claim 5, wherein the upper surface pressing member of the film piece pressing mechanism presses the piece of film against lateral sides of the upper surface of the article in the direction of width.

* * * * *